US011422507B2

(12) United States Patent
Wang et al.

(10) Patent No.: US 11,422,507 B2
(45) Date of Patent: Aug. 23, 2022

(54) PROTECTION CASING ASSEMBLY FOR WEARABLE DEVICE

(71) Applicant: EVOLUTIVE LABS CO., LTD., Taipei (TW)

(72) Inventors: Ching-Fu Wang, Taipei (TW); Sheng-Che Su, Taipei (TW); Po-Wen Hsiao, Taipei (TW); Chia-Ho Lin, Taipei (TW)

(73) Assignee: EVOLUTIVE LABS CO., LTD., Taipei (TW)

( * ) Notice: Subject to any disclaimer, the term of this patent is extended or adjusted under 35 U.S.C. 154(b) by 482 days.

(21) Appl. No.: 16/591,194

(22) Filed: Oct. 2, 2019

(65) Prior Publication Data

US 2020/0363773 A1 Nov. 19, 2020

(30) Foreign Application Priority Data

May 17, 2019 (TW) ..... 108117188

(51) Int. Cl.
*G04B 37/00* (2006.01)
*A45C 11/00* (2006.01)

(52) U.S. Cl.
CPC ..... *G04B 37/005* (2013.01); *A45C 2011/003* (2013.01)

(58) Field of Classification Search
CPC .. G04B 37/005; G04B 37/22; G04B 37/0058; A45C 2011/003
USPC ..... 368/281
See application file for complete search history.

(56) References Cited

U.S. PATENT DOCUMENTS 3,789,601 A * 2/1974 Bergey ..... G04G 5/04 368/239
4,178,751 A * 12/1979 Liautaud ..... G04B 37/1486 968/327
4,396,298 A * 8/1983 Ripley ..... G04B 37/1486 968/452
5,206,841 A * 4/1993 Boucheron ..... G04B 37/1486 368/283

(Continued)

FOREIGN PATENT DOCUMENTS

CN 206481355 U 9/2017
TW I548548 9/2016

(Continued)

OTHER PUBLICATIONS

Office Action and Search Report dated Dec. 17, 2019 issued by Taiwan Intellectual Property Office for counterpart application No. 108117188.

(Continued)

*Primary Examiner* — Edwin A. Leon
(74) *Attorney, Agent, or Firm* — WPAT, P.C., Intellectual Property Attorneys; Anthony King

(57) ABSTRACT

The present disclosure provides a protection casing assembly for a wearable device. The protection casing assembly includes a main case and a frame. The main case has a first accommodation space and configured to allow a wearable device to be disposed detachably. When the wearable device is disposed in the first accommodation space, the wearable device and the main case define a second accommodation space adjacent to at a device surface of the wearable device. The frame is detachably disposed in the second accommodation space.

13 Claims, 25 Drawing Sheets

(56) References Cited

U.S. PATENT DOCUMENTS

| | | | | |
|---|---|---|---|---|
| 7,946,758 | B2 * | 5/2011 | Mooring | G04B 37/1413 368/88 |
| 9,737,123 | B2 * | 8/2017 | Wright | A45C 13/008 |
| 10,261,547 | B1 * | 4/2019 | DiMeglio | G06F 1/163 |
| 2006/0291336 | A1 * | 12/2006 | Hyun | G04B 37/225 368/282 |
| 2015/0137731 | A1 * | 5/2015 | Kim | G04B 37/1486 361/679.01 |
| 2015/0296963 | A1 * | 10/2015 | Byun | G04G 17/08 224/191 |
| 2016/0058375 | A1 | 3/2016 | Rothkopf | |
| 2016/0325646 | A1 | 11/2016 | Tanabe et al. | |
| 2019/0068231 | A1 | 2/2019 | Wang | |

FOREIGN PATENT DOCUMENTS

| | | |
|---|---|---|
| TW | M542298 | 5/2017 |
| TW | M552285 U | 12/2017 |
| TW | I636350 | 9/2018 |
| TW | I646881 | 1/2019 |

OTHER PUBLICATIONS

English Abstract Translation of Foreign Reference CN 206481355U.
US Patent Publication 20160058375 is a corresponding application to Foreign Reference TW I636350.
US Patent Publication 20160325646 is a corresponding application to Foreign Reference TW I548548.
Office Action and Search Report dated Apr. 24, 2020 issued by Taiwan Intellectual Property Office for counterpart application No. 108117188.
English Abstract Translation of Foreign Reference TW M542298.
US Patent Publication 20190068231 is the corresponding application to Foreign Reference TW I646881.
Office Action, Cited References and Search Report dated Dec. 30, 2020 issued by Taiwan Intellectual Property Office for corresponding Taiwan, R.O.C. Patent application No. 108117188.
English Translation of New Cited Reference TWM552285U.

* cited by examiner

PROTECTION CASING ASSEMBLY FOR WEARABLE DEVICE

PRIORITY CLAIM AND CROSS-REFERENCE

This application claims priority of Taiwan patent application Ser. No. 108117188 filed on May 17, 2019, which is incorporated by reference in its entirety.

TECHNICAL FIELD

The present disclosure relates generally to a protection casing assembly, more particularly, to a protection casing assembly for a wearable device.

DISCUSSION OF THE BACKGROUND

With the development of technology, wearable devices are getting more sophisticated. Specifically, in addition to their original functions, many wearable devices further have some functions of consumer electronic devices, such as, digital information storage, digital media playback, instant messaging; hence, more precision electronic devices have to be disposed within these wearable devices.

However, since the wearable devices are frequently exposed to the external environment and are easily neglected, occurrences of impact and thus resultant damages to the internal precision electronic components are greatly increased. Yet, existing protective accessories to wearable devices exhibit lower protection level and the convenience of their use also has a considerable degree of improvement.

SUMMARY

Some embodiments of the present disclosure provide a protection casing assembly for a wearable device. The protection casing assembly includes a main case and a frame. The main case has a first accommodation space and configured to allow a wearable device to be disposed detachably. When the wearable device is disposed in the first accommodation space, the wearable device and the main case define a second accommodation space adjacent to at a device surface of the wearable device. The frame is detachably disposed in the second accommodation space.

Some embodiments of the present disclosure provide a wearable device protection casing. The wearable device protection casing includes a first accommodation space. The first accommodation space is configured to allow a wearable device to be disposed detachably. When the wearable device is disposed in the first accommodation space, the wearable device and the wearable device protection casing define a second accommodation space adjacent to at a device surface of the wearable device. The second accommodation space is configured to allow a frame to be disposed detachably.

Some embodiments of the present disclosure provide a protection casing assembly for a wearable device. The protection casing assembly includes a main case and a frame. The main case has an opening and an accommodation space. The opening is configured to receive a wearable device. The accommodation space is configured to accommodate the wearable device. The frame is disposed in the opening and inserted between the main case and the wearable device, and configured to secure the wearable device in the accommodation space.

The foregoing has outlined rather broadly the features and technical advantages of the present disclosure in order that the detailed description of the disclosure that follows may be better understood. Additional features and advantages of the disclosure will be described hereinafter, and form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

A more complete understanding of the present disclosure may be derived by referring to the detailed description and claims when considered in connection with the Figures, where like reference numbers refer to similar elements throughout the Figures.

DETAILED DESCRIPTION

Figure 1A:
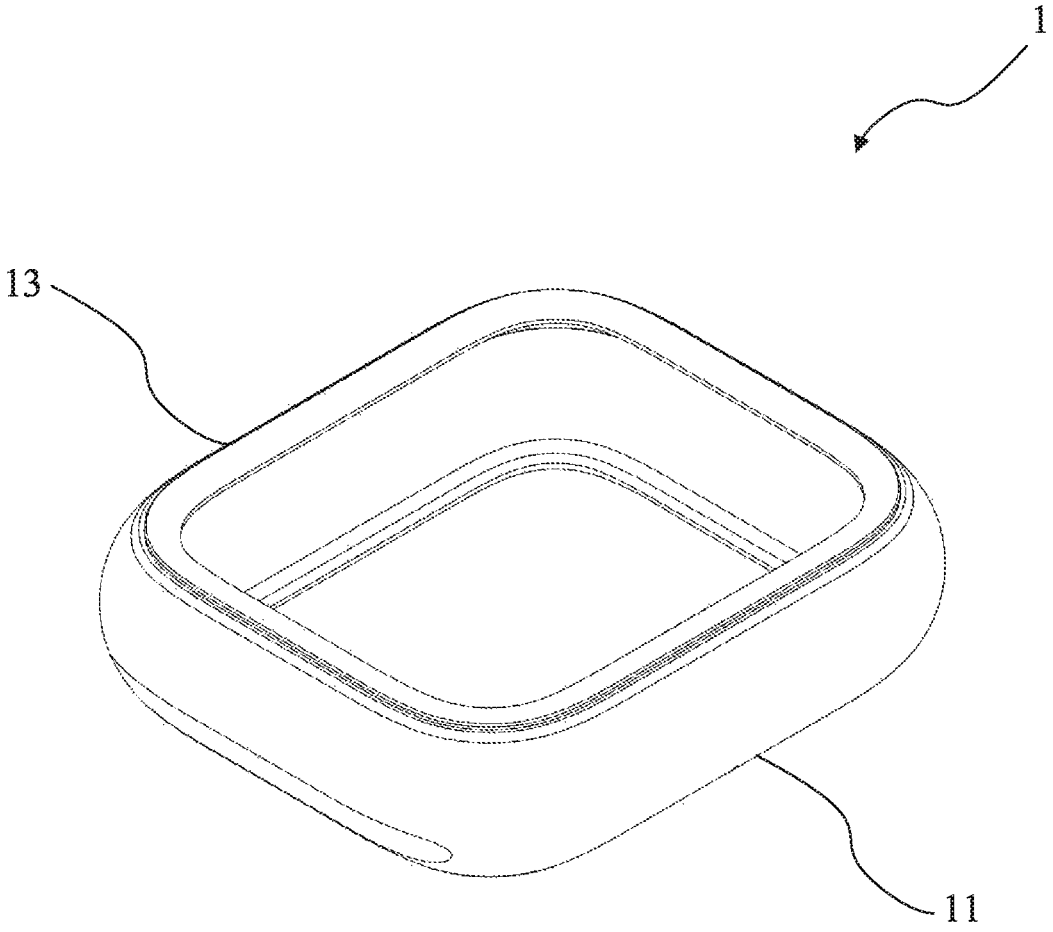
FIG. 1A is stereogram illustrating a protection casing assembly according to some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Embodiments of the present disclosure are discussed in detail below. It should be appreciated, however, that the present disclosure provides many applicable inventive concepts that can be embodied in a wide variety of specific contexts. The specific embodiments discussed are merely illustrative and do not limit the scope of the disclosure.

Further, spatially relative terms, such as "beneath," "below," "lower," "above," "upper," "lower," "left," "right" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. It should be understood that when an element is referred to as being "connected to" or "coupled to" another element, it may be directly connected to or coupled to the other element, or intervening elements may be present.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in the respective testing measurements. Also, as used herein, the term "about" generally means within 10%, 5%, 1%, or 0.5% of a given value or range. Alternatively, the term "about" means within an acceptable standard error of the mean when considered by one of ordinary skill in the art. Other than in the operating/working examples, or unless otherwise expressly specified, all of the numerical ranges, amounts, values and percentages such as those for quantities of materials, durations of times, temperatures, operating conditions, ratios of amounts, and the likes thereof disclosed herein should be understood as modified in all instances by the term "about." Accordingly, unless indicated to the contrary, the numerical parameters set forth in the present disclosure and attached claims are approximations that can vary as desired. At the very least, each numerical parameter should at least be construed in light of the number of reported significant digits and by applying ordinary rounding techniques. Ranges can be expressed herein as from one endpoint to another endpoint or between two endpoints. All ranges disclosed herein are inclusive of the endpoints, unless specified otherwise.

Figure 1B:
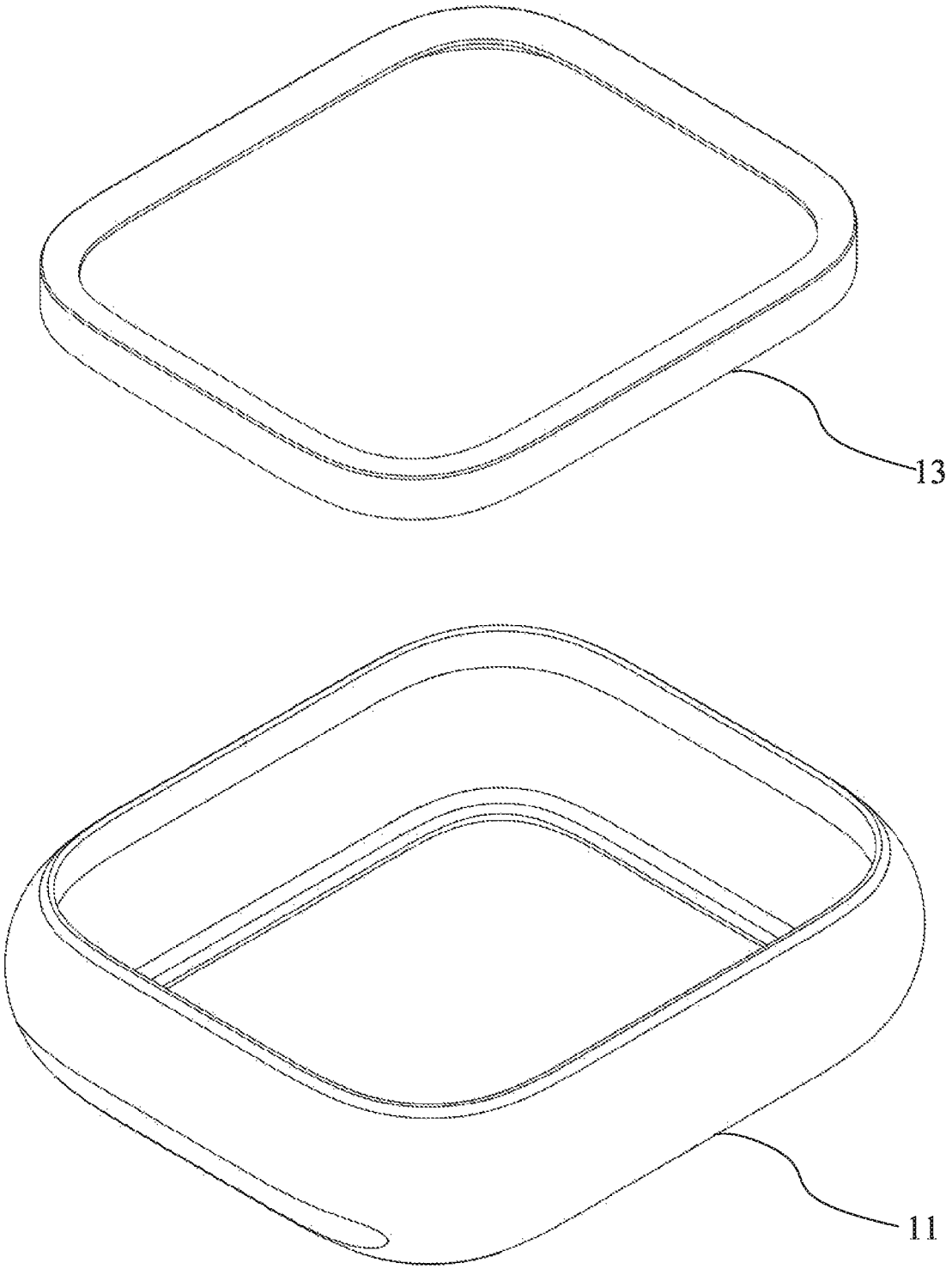
FIG. 1B is an exploded view of a protection casing assembly according to some embodiments of the present disclosure.
Figure 1C:
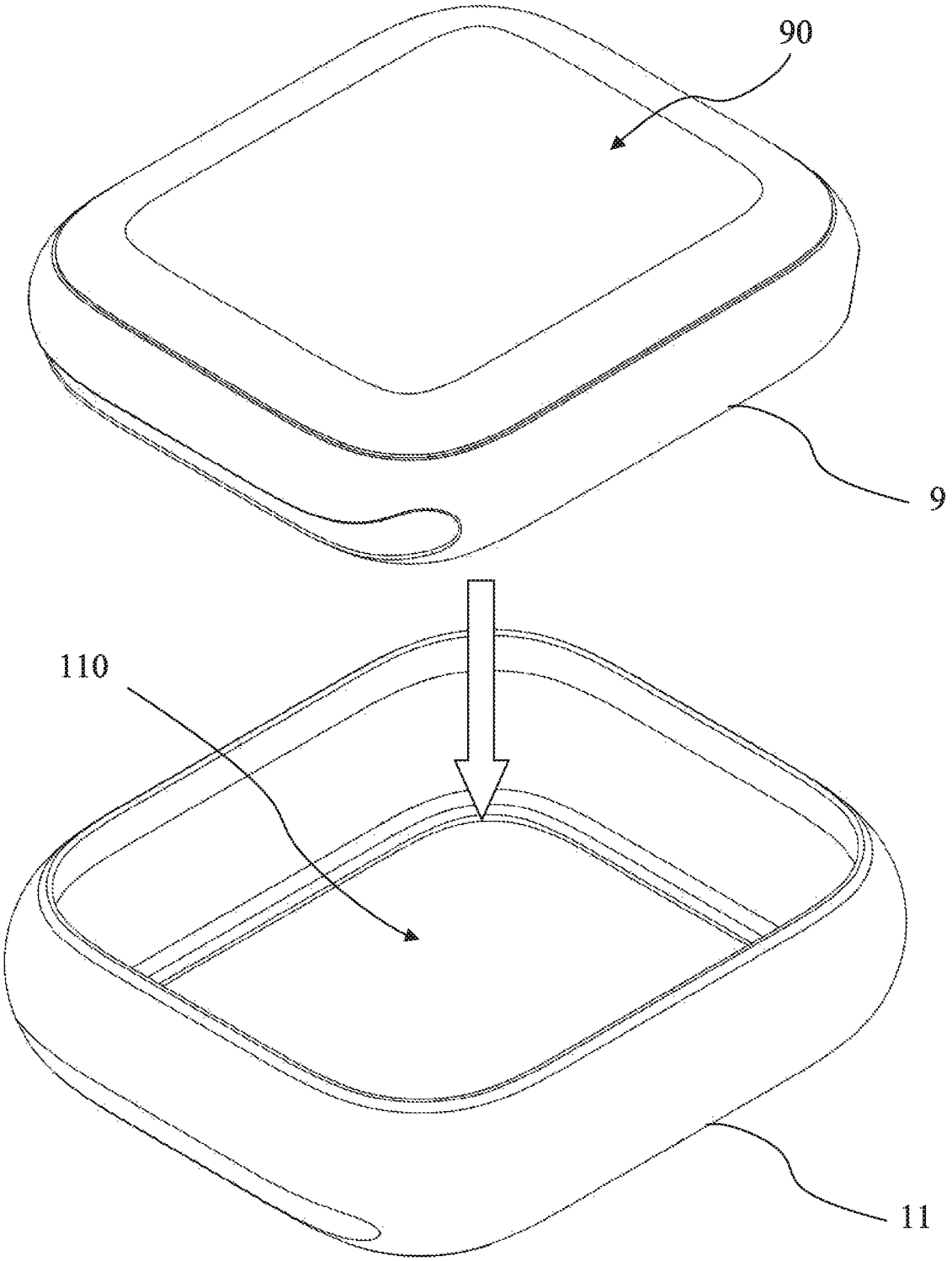
FIGS. 1C and 1D are schematic diagrams illustrating the use of a protection casing assembly according to some embodiments of the present disclosure.
Figure 1D:
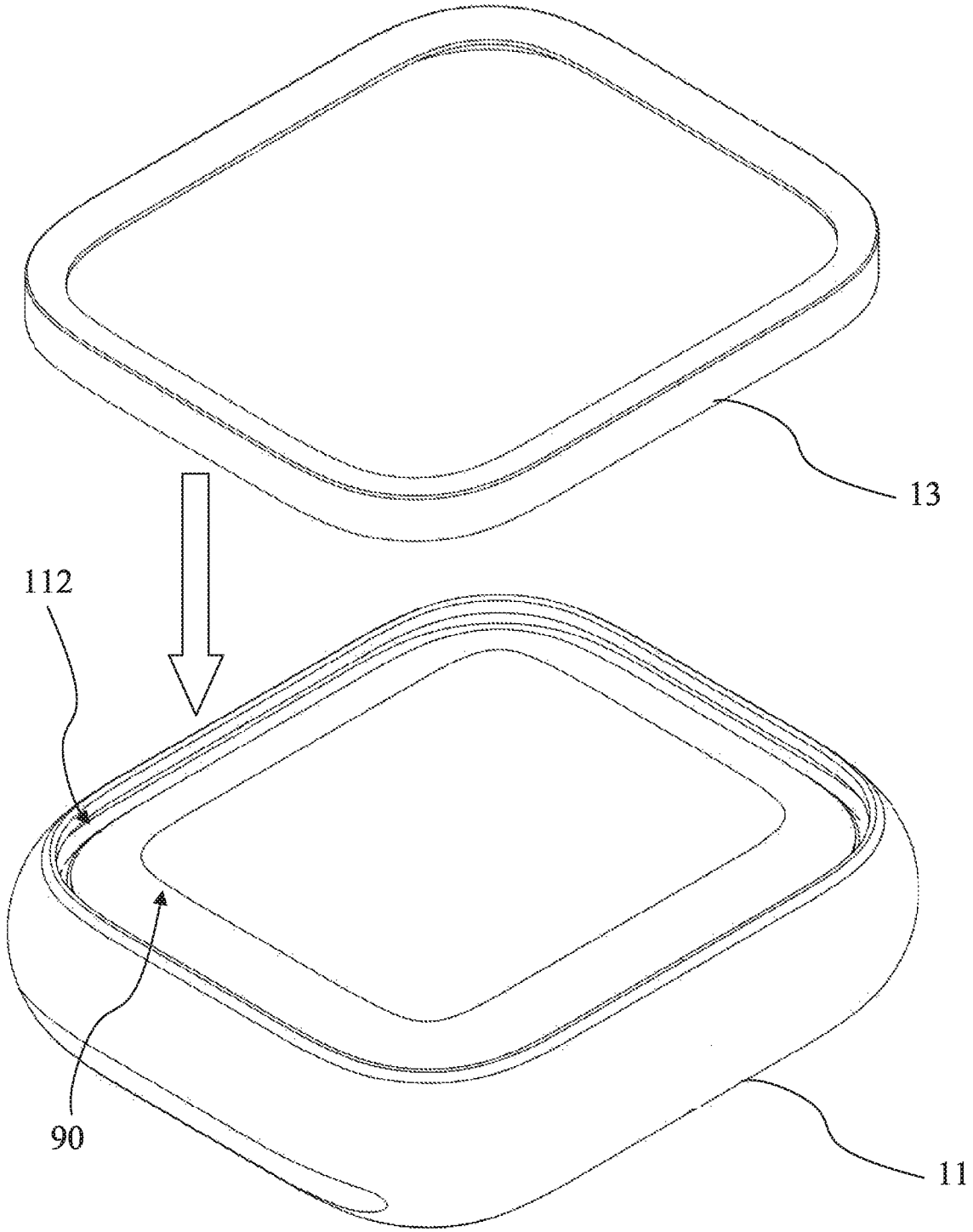

Referring to FIG. 1A and FIG. 1B. FIG. 1A is a stereogram illustrating a protection casing assembly 1 of the first embodiment of the present disclosure. FIG. 1B is an exploded view of the protection casing assembly 1 according to the first embodiment of the present disclosure. As shown in the figures, the protection casing assembly 1 includes a main case 11 and a frame 13. Referring to FIGS. 1C and 1D together. FIGS. 1C and 1D are schematic diagrams illustrating the use of the protection casing assembly 1 according to the first embodiment of the present disclosure.

Specifically, the main case 11 has a first accommodation space 110, which may be configured to accommodate a wearable device 9. The wearable device 9 may be detachably disposed within the first accommodation space 110 of the main case 11. As shown in the figures, when the wearable device 9 may be disposed in the first accommodation space 110, the wearable device 9 and the main case 11 define a second accommodation space 112 in adjacent to a device surface 90 of the wearable device 9. The second accommodation space 112 may be configured to accommodate the frame 13. Further, when the wearable device 9 may be disposed in the first accommodation space 110 and defines the second accommodation space 112 together with the main case 11, the frame 13 may be detachably disposed in the second accommodation space 112.

Figure 2A:
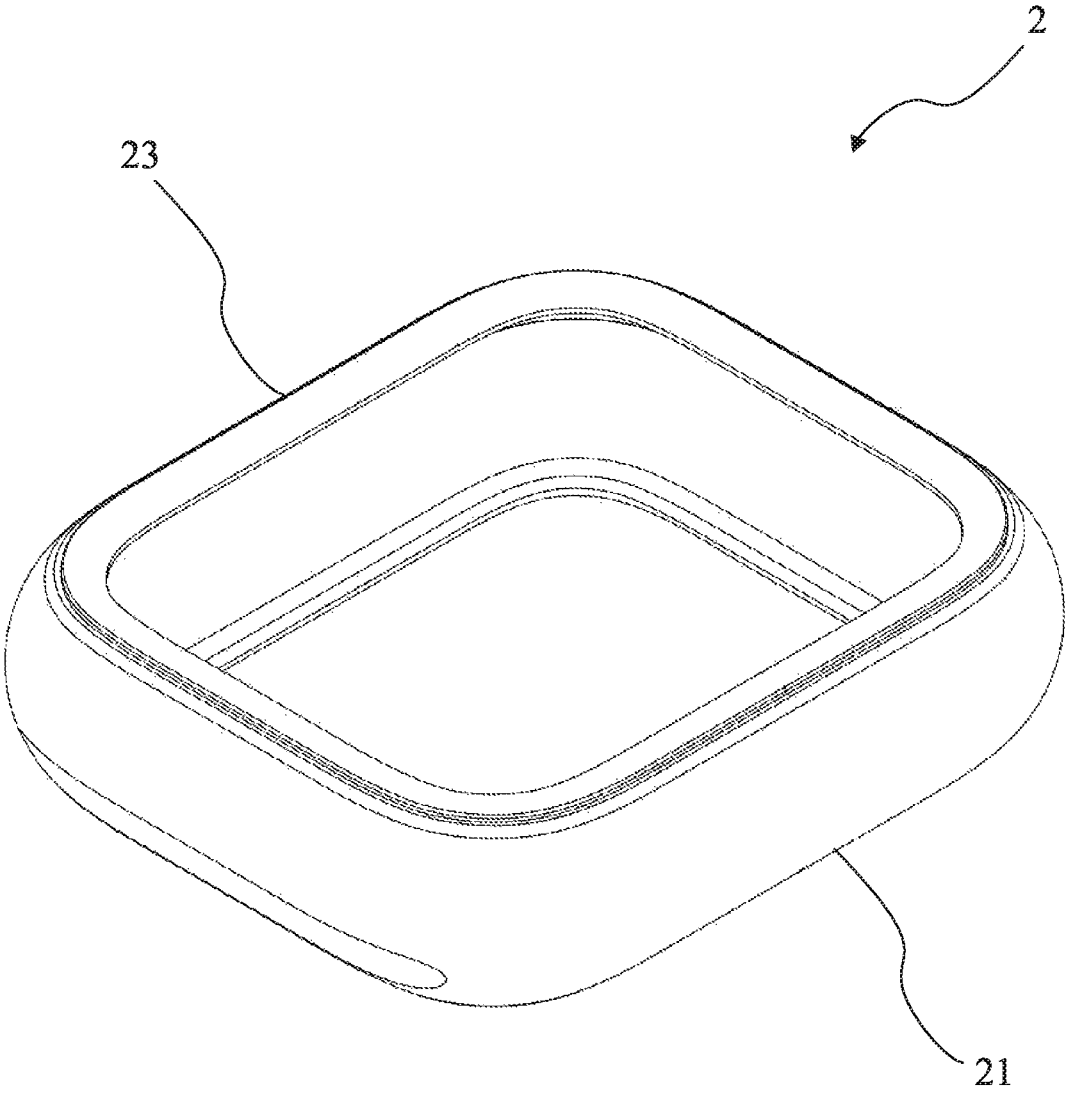
FIG. 2A is stereogram illustrating a protection casing assembly according to some embodiments of the present disclosure.
Figure 2B:
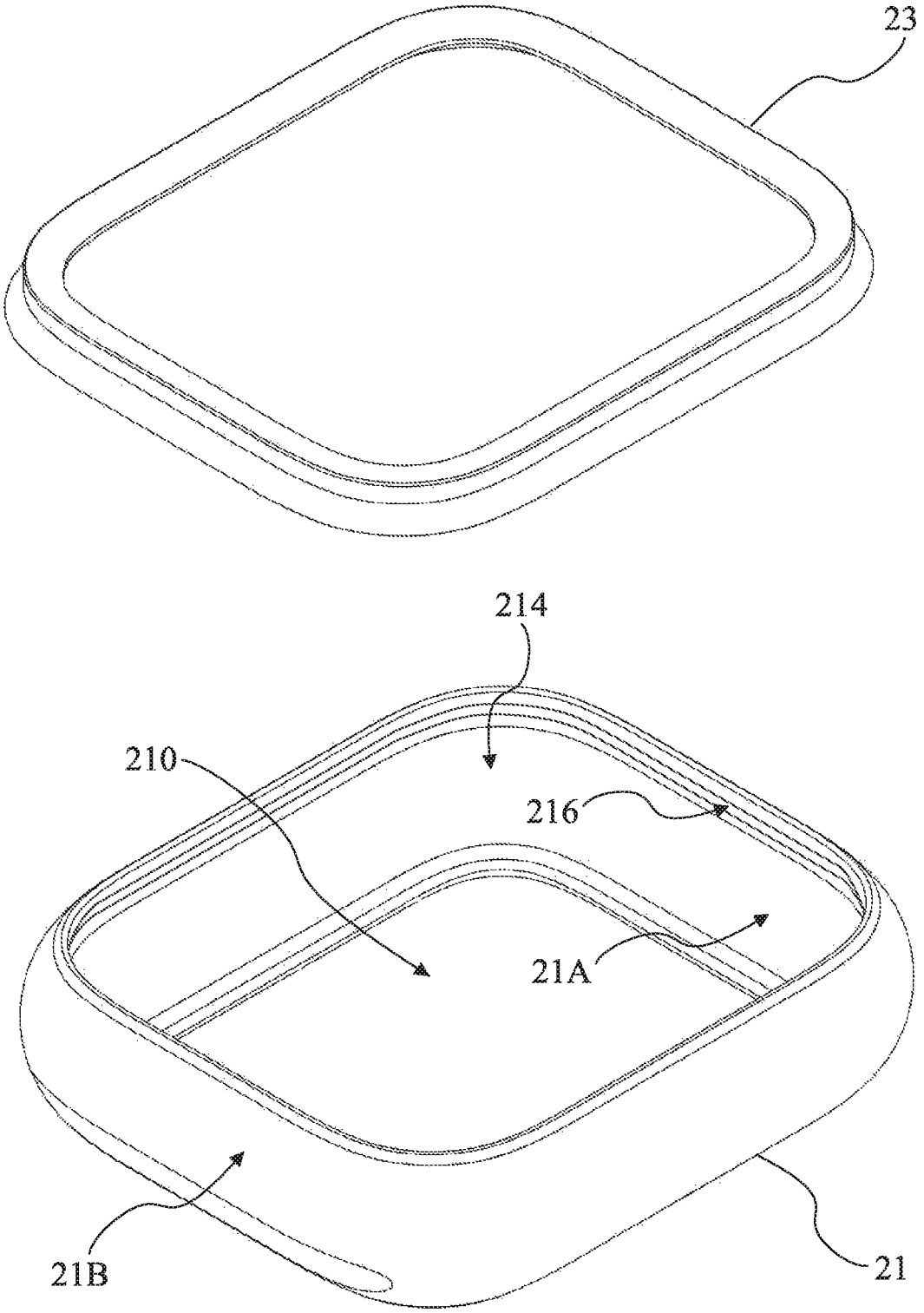
FIG. 2B is an exploded view of a protection casing assembly according to some embodiments of the present disclosure.
Figure 2C:
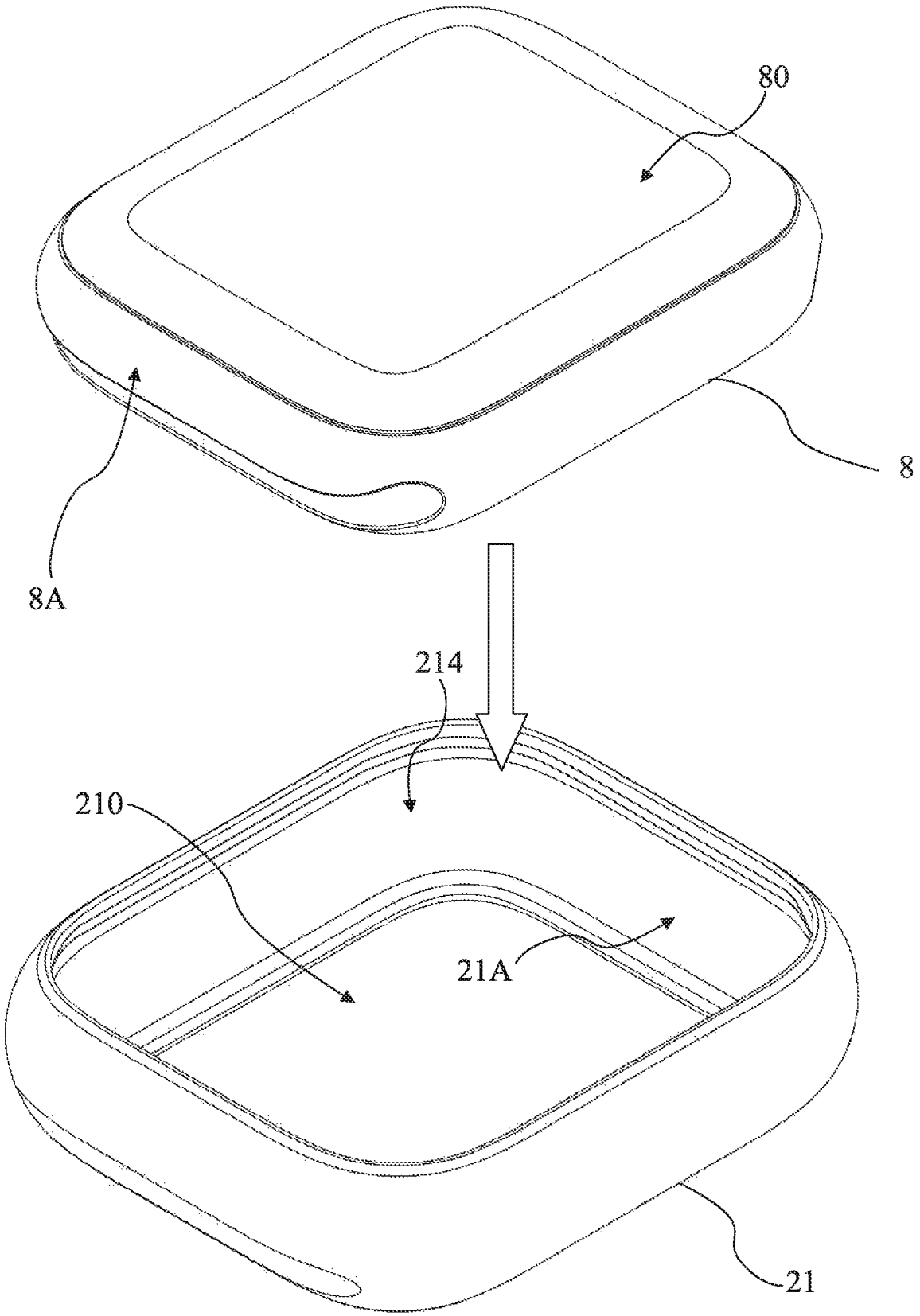
FIGS. 2C and 2D are schematic diagrams illustrating the use of a protection casing assembly according to some embodiments of the present disclosure.
Figure 2D:
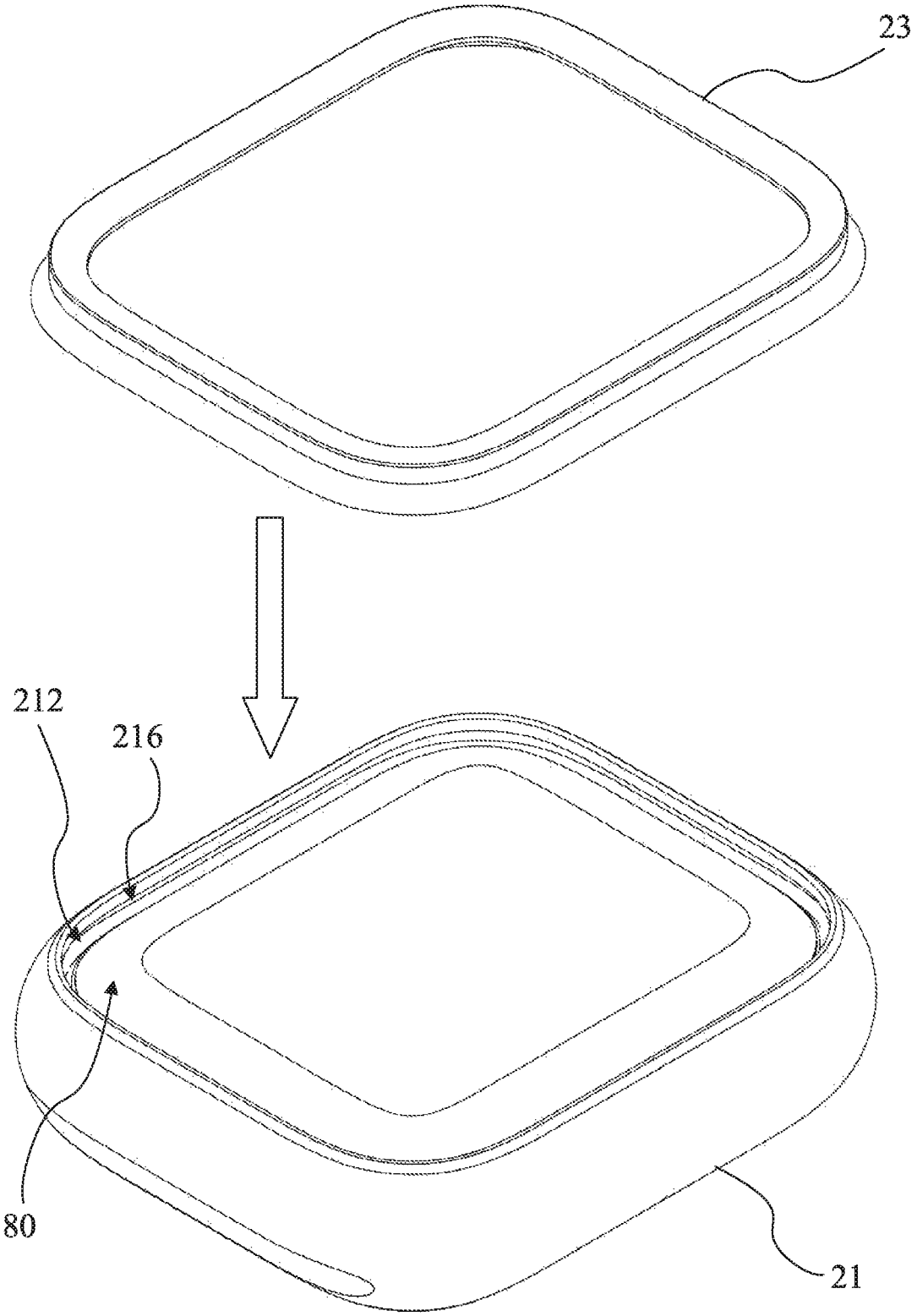

Referring to FIGS. 2A and 2B. FIG. 2A is a stereogram of a protection casing assembly 2 in accordance with the second embodiment of the present disclosure. FIG. 2B is an exploded view of the protection casing assembly 2 in accordance with the second embodiment of the present disclosure. The second embodiment further exemplifies the details of the protection casing assembly of the present disclosure. As shown in the figures, the protection casing assembly 2 includes a main case 21 and a frame 23. The main case 21 has an opening 214, an inner peripheral surface 21A and an outer peripheral surface 21B corresponding to the inner peripheral surface 21A. The inner peripheral surface 21A defines a first accommodation space 210. Referring to FIGS. 2C and 2D together. FIGS. 2C and 2D are schematic diagrams illustrating the use of the protection casing assembly 2 in accordance with the second embodiment of the present disclosure.

In particular, the opening 214 of the main case 21 may be configured to receive a wearable device 8, and the first accommodation space 210 may be configured to accommodate the wearable device 8.

The wearable device 8 may be detachably disposed in the first accommodation space 210 of the main case 21. When the wearable device 8 is disposed in the first accommodation space 210, the opening 214 exposes a display surface 80 of the wearable device 8, and the inner peripheral surface 21A wraps around a device peripheral surface 8A of the wearable device 8.

As shown in the figures, when the wearable device 8 is disposed in the first accommodation space 210 via the opening 214, the wearable device 8 and the main case 21 define a second accommodation space 212 therebetween. The second accommodation space 212 may be mainly in adjacent to the display surface 80 of the wearable device 8. In brief, when the wearable device 8 is disposed in the first accommodation space 210, the second accommodation space 212 may be defined at a position adjacent to the display surface 80 and between the device peripheral surface 8A and the inner peripheral surface 21A.

More specifically, when the inner peripheral surface 21A of the main case 21 wraps around the device peripheral surface 8A of the wearable device 8, a portion of the inner peripheral surface 21A in adjacent to the display surface 80 may not be tightly fitted with a portion of the device peripheral surface 8A of the wearable device 8, thereby creating gap, and this gap includes the second accommodation space 212.

Accordingly, after disposing the wearable device 8 in the first accommodation space 210 of the main case 21, the frame 23 may be disposed in the second accommodation space 212. In other words, the frame 23 may be disposed at the opening 214 end of the main case 21, and may be inserted into the gap between the main case 21 and the wearable device 8 by means of insertion, thereby securing or fixing the wearable device 8 in the first accommodation space 210.

In some embodiments, the main case 21 has a notch 216 encircling the inner peripheral surface 21A and may be disposed at the inner peripheral surface 21A adjacent to the opening 214 end. The second accommodation space 212 includes the notch 216. Therefore, when the frame 23 is inserted into the gap between the main case 21 and the wearable device 8, the frame 23 may be further inserted into the notch 216. In some embodiments, the main case 21 itself has the basic functions of clapping and fixing the wearable device 8, and the frame 23 being inserted between the main case 21 and the wearable device 8 may be configured to strengthen the fixation of the wearable device 8 in the main case 21.

Figure 2E:
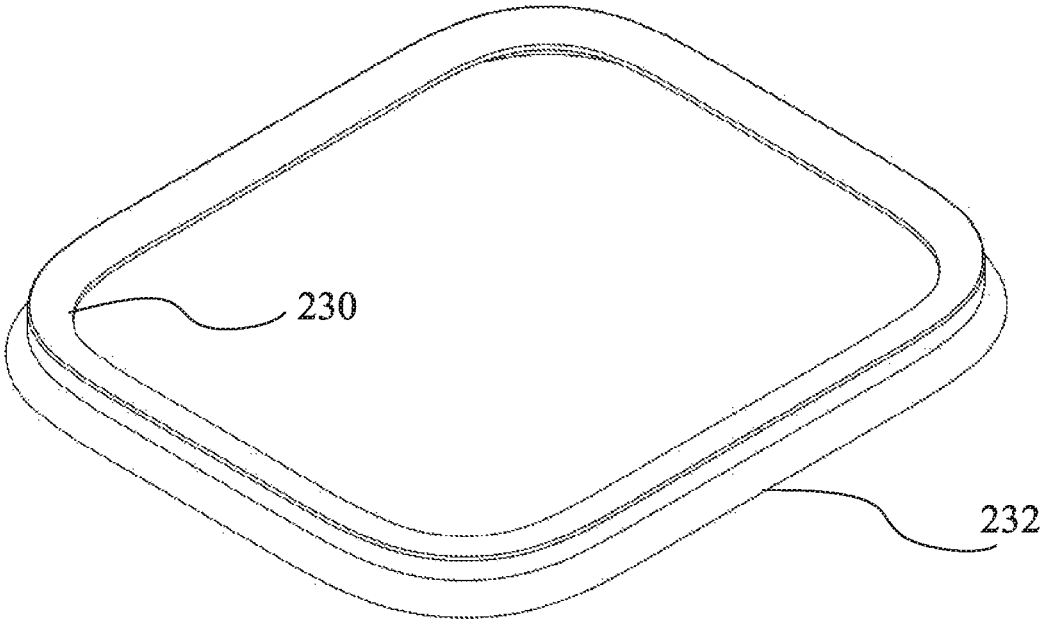
FIG. 2E is a stereogram illustrating a frame according to some embodiments of the present disclosure.
Figure 2F:
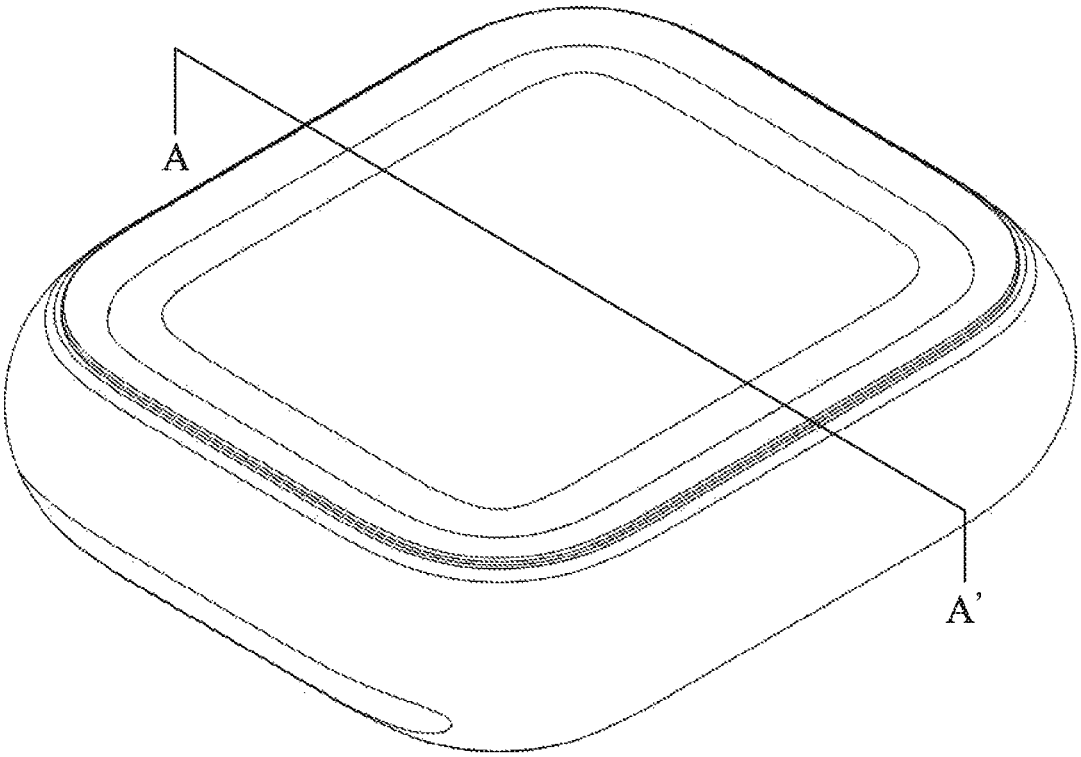
FIG. 2F is a stereogram illustrating a protection casing assembly in combination with a wearable device according to some embodiments of the present disclosure.
Figure 2G:
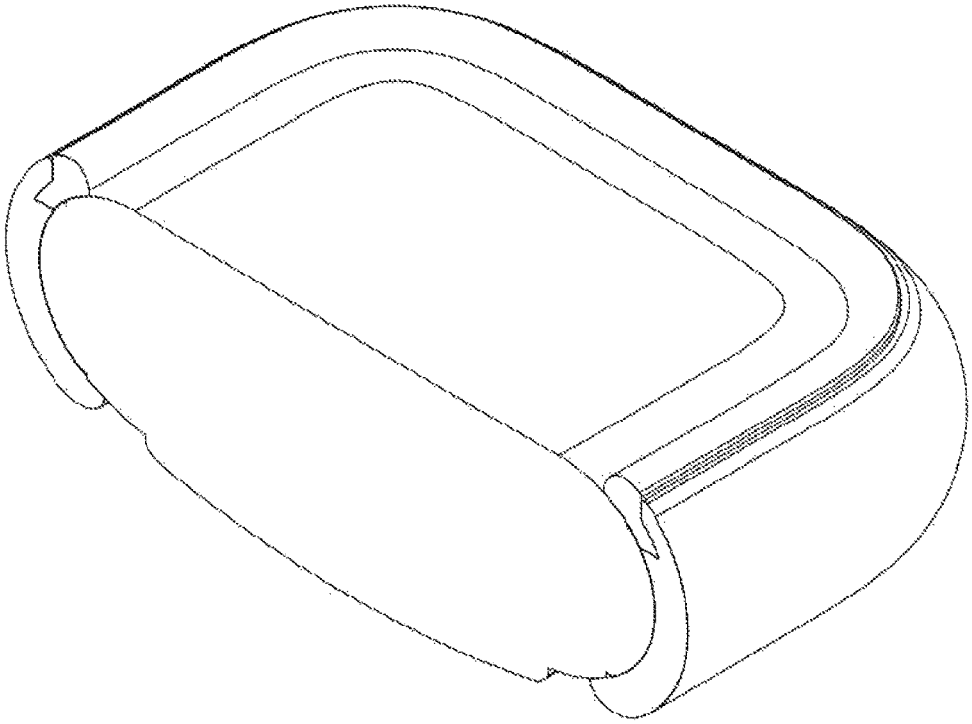
FIG. 2G is a cross-sectional view of a protection casing assembly according to some embodiments of the present disclosure.
Figure 2G:
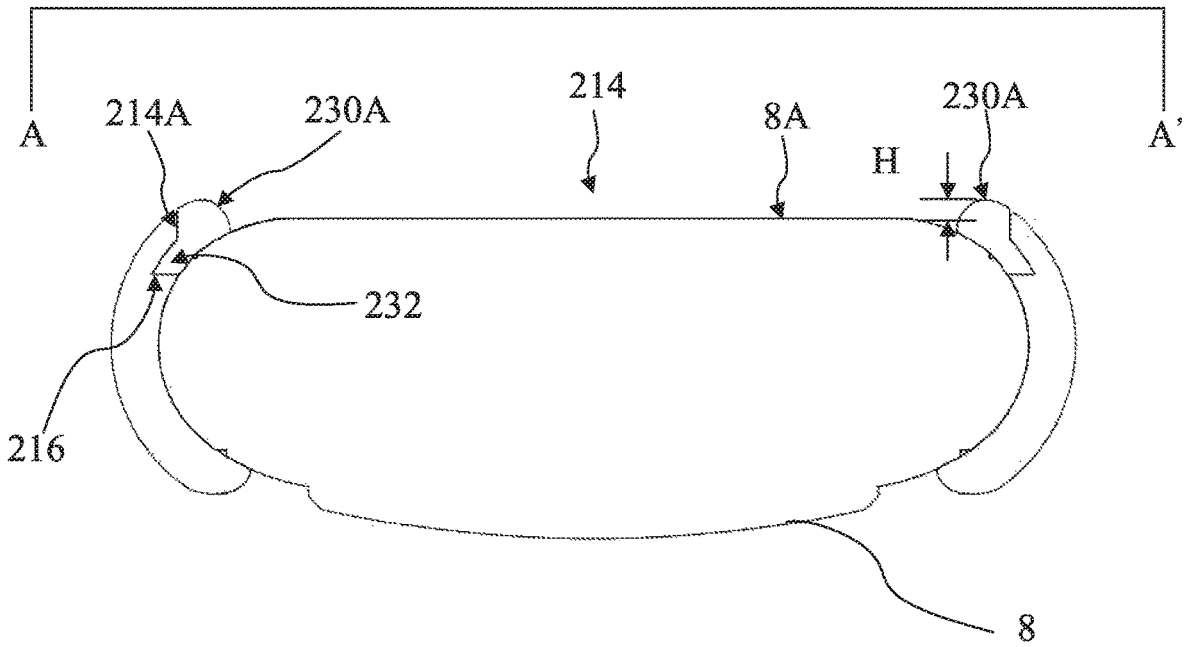

Referring to FIGS. 2E to 2G. FIG. 2E is a stereogram illustrating the frame 23 in accordance with the second embodiment of the present disclosure. FIG. 2F is a stereogram illustrating the protection casing assembly 2 in accordance with the second embodiment of the present disclosure in combination with the wearable device 8. FIG. 2G is a cross-sectional view of the protection casing assembly 2 in accordance with the second embodiment of the present disclosure in combination with the wearable device 8. In some embodiments, the frame 23 further includes a frame main body 230 and an insertion part 232. The insertion part 232 may be configured to be inserted between the main case 21 and the wearable device 8; that is, inserted into the second accommodation space 212.

Further, the insertion part 232 may be configured to be inserted into the notch 216 of the second accommodation space 212, so that after the insertion part 232 of the frame main body 230 is inserted into the notch 216, the frame main body 230 may be correspondingly secured at a periphery 214A of the opening 214. In some embodiments, when the frame main body 230 is correspondingly disposed at the periphery 214A of the opening 214, the frame 23 has a bulge 230A corresponding to the periphery 214A of the opening 214 of the main case 21.

In some embodiments, when the wearable device 8 is accommodated in the first accommodation space 210, and the frame 23 may be disposed in the second accommodation space 212 and combined with the main case 21, to further strengthen the protection for the display surface 8A of the wearable device 8, and at the same time adapt to the extension of the eternal curvature of the main case 21, the bulge 230A of the frame 23 has a height H relative to the display surface 8A of the wearable device 8. The height H ranges from about 0.1 mm to about 3.5 mm. In some embodiments, the height H ranges from about 0.8 mm to about 1.2 mm.

Figure 2H:
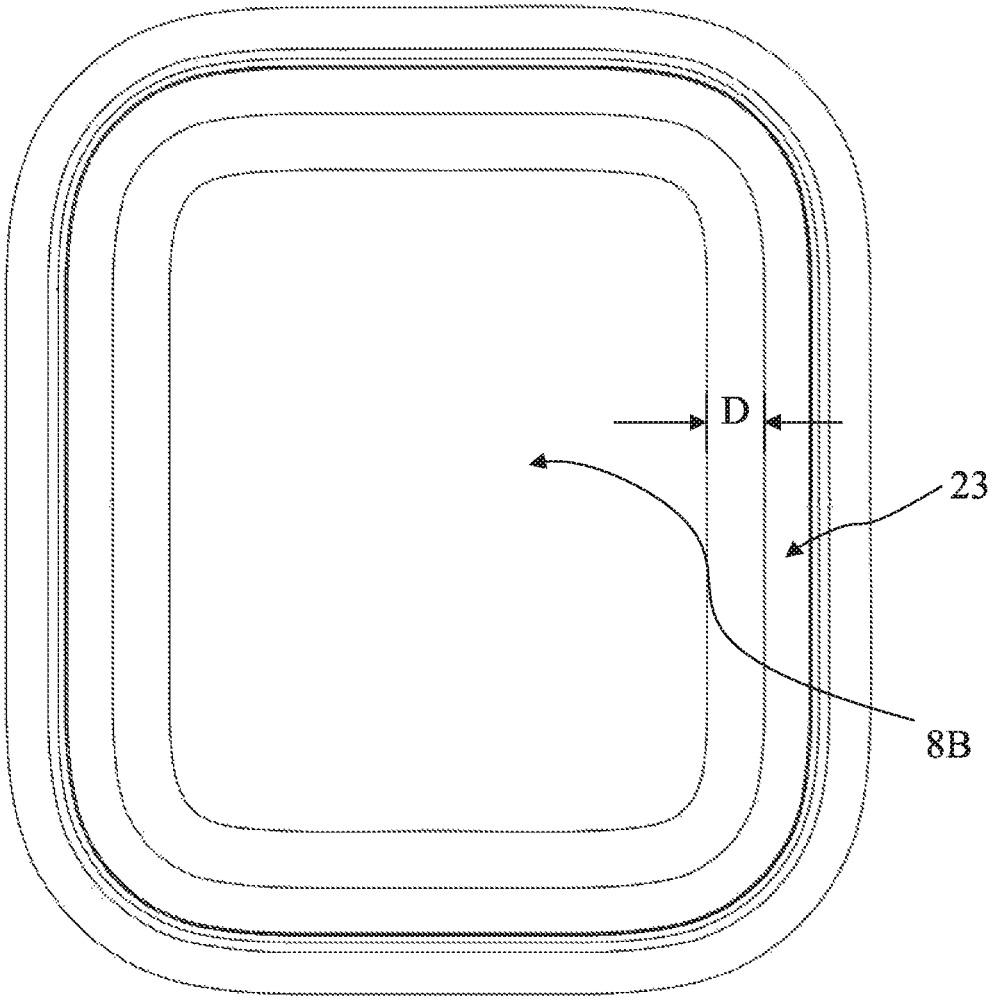
FIG. 2H is a top view of a protection casing assembly according to some embodiments of the present disclosure.

Referring to FIG. 2H, which is a top view of the protection casing assembly 2 in accordance with the second embodiment of the present disclosure in combination with the wearable device 8. In some embodiments, the display surface 8A of the wearable device 8 may include a touch screen having a touch sensing range 8B for sensing the touch control operations. When the wearable device 8 is accommodated in the first accommodation space 210, and the frame 23 may be disposed in the second accommodation space 212 and combined with the main case 21, an inner edge of the frame 23 has a distance D with respect to the edge the touch sensing range 8B.

Figure 2I:
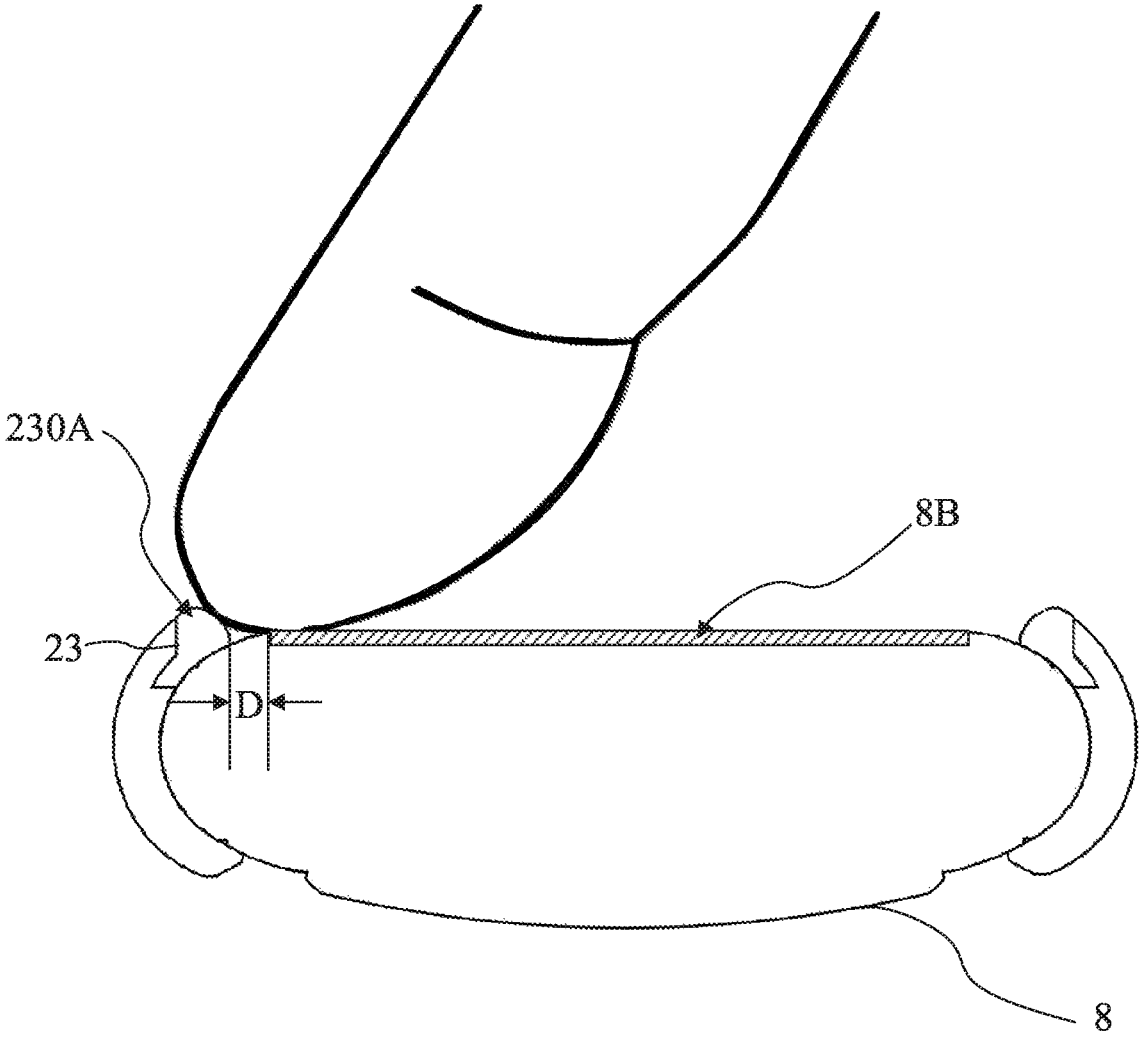
FIG. 2I is a schematic diagram illustrating a touch control operation by a user with a wearable device according to some embodiments of the present disclosure.

Referring to FIG. 2I, which is a schematic diagram illustrating the touch control operation by a user with the wearable device 8 in accordance with the second embodiment of the present disclosure. In should be noted that, in some circumstances, the touch control to the edge of the touch sensing range 8B may be affected by the bulge 230A of the frame 23 while the frame 23 is too close to the edge of the touch sensing range 8B. Therefore, as shown in the figures, with a buffer via the distance D, when the user performs the touch control operation within the touch sensing range 8B of the wearable device 8, the touch control to the edge of the touch sensing range 8B may not be affected by the bulge 230A of the frame 23.

In some embodiments, the design of the distance D may be dependent on the design of the height H. As shown in FIGS. 2G and 2I and above descriptions, the distance D and the height H may define an operation space adjacent to the edge of the touch control range 8B, and the operation space may not be expanded or reduced arbitrarily. For example, the distance D being too small or the height H being too large may cause the difficulty in touch control operation. On the other hand, the distance D being too large or the height H being too small may decrease the fitness between the frame 23 and the touch control screen, thereby deteriorating the protection level or the aesthetics. Therefore, another feature of the present disclosure is to provide an appropriate distance D and height H to achieve a better design. In one embodiment, designing a better ration between the distance D and the height H may provide a suitable allowable operation space that does not affect the accuracy of touch control and the fitness between the frame and the screen while at the same time preserving the aesthetics. For example, when reducing the ratio between the distance D and the height H, the accuracy of the touch control to the edge of the touch control range 8B will tend to be affected by the bulge 230A, whereas when increasing the ratio between the distance D and the height H, the utility and aesthetics shall also be taken into account. In this way, to provide a better touch-control user experience, the ratio between the distance D and the height H may be about 0.9 to about 1.3. In other words, combining the range for the height H and the range for the ratio, the distance D may be about 0.09 mm to about 4.5 mm, or about 1 mm to about 2 mm in some embodiments. The ratio between the distance D and the height H may equal to or be greater than 1.

Figure 2J:
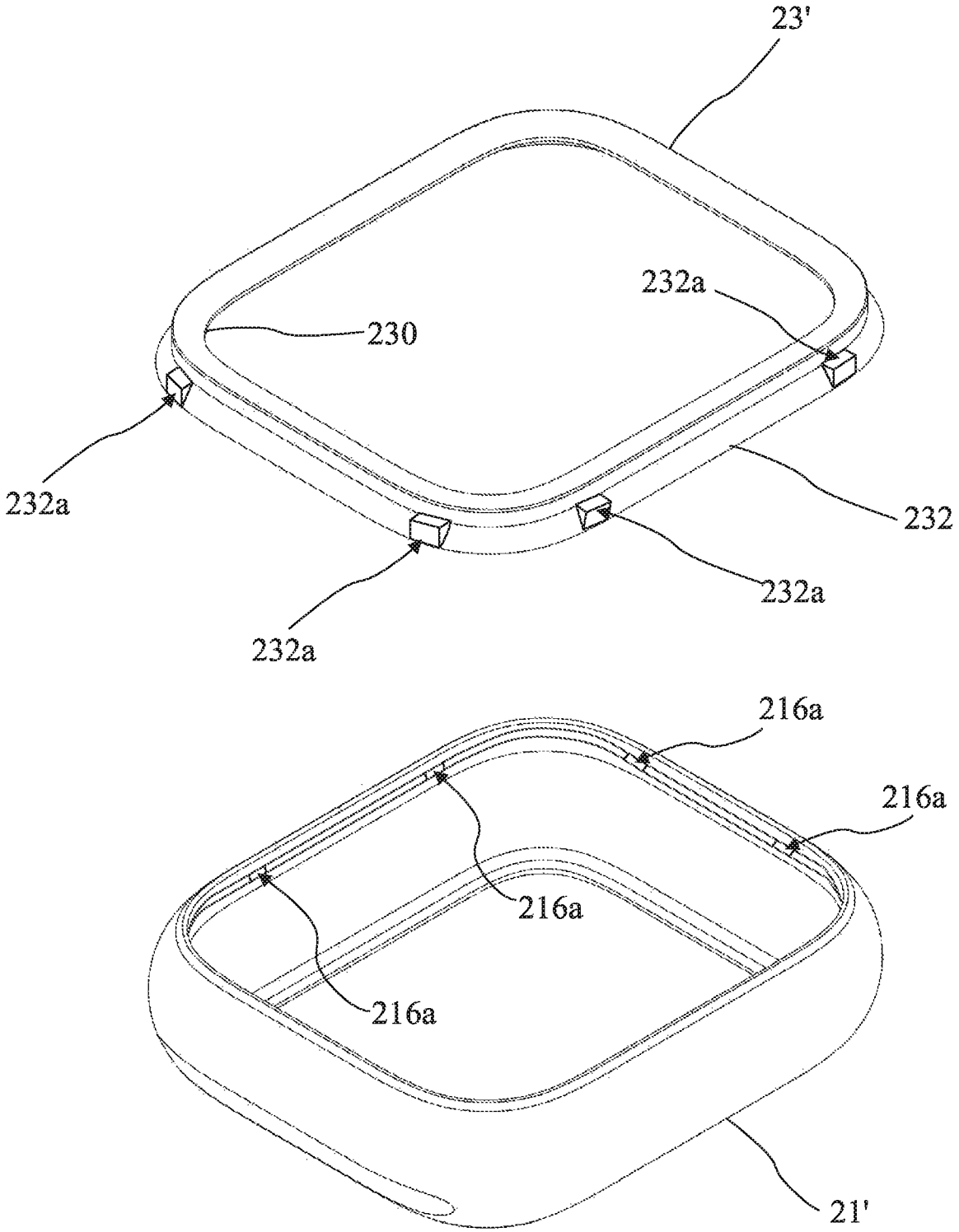
FIG. 2J is an exploded view of a protection casing assembly according to some embodiments of the present disclosure.

Referring to FIG. 2J, which is an exploded view of a protection casing assembly 23' in accordance with the second embodiment of the present disclosure. In some embodiments, the protection casing assembly 23' includes a frame main case 21' and a frame 23'. The frame 23' may be similar to the frame 23 except that the insertion part 232 of the frame 23' further includes at least one positioning bump 232*a*. The main case 21' may be similar to the main case 21 except that the notch 216 of the main case 23' further includes at least one positioning notch 216*a* corresponding to at least one positioning bump 232*a*.

In particular, when the insertion part 232 of the frame 23' is inserted into the notch 216 of the second accommodation space 212 of the main case 21', at least one positioning bump 232*a* may be inserted and fitted into at least one positioning notch 216*a*, thereby strengthen the fixation of the frame 23' and the main case 21'. It should be noted that the number of the positioning bump 232*a* and the positioning notch 216*a* may be determined as needed. In some embodiments, the main case 21' and frame 23' have four corresponding lateral sides, respectively, and each side may have two pairs of positioning bump 232*a* and the positioning notch 216*a*. Therefore, the four lateral sides have eight pairs of positioning bump 232*a* and the positioning notch 216*a*.

Figure 3A:
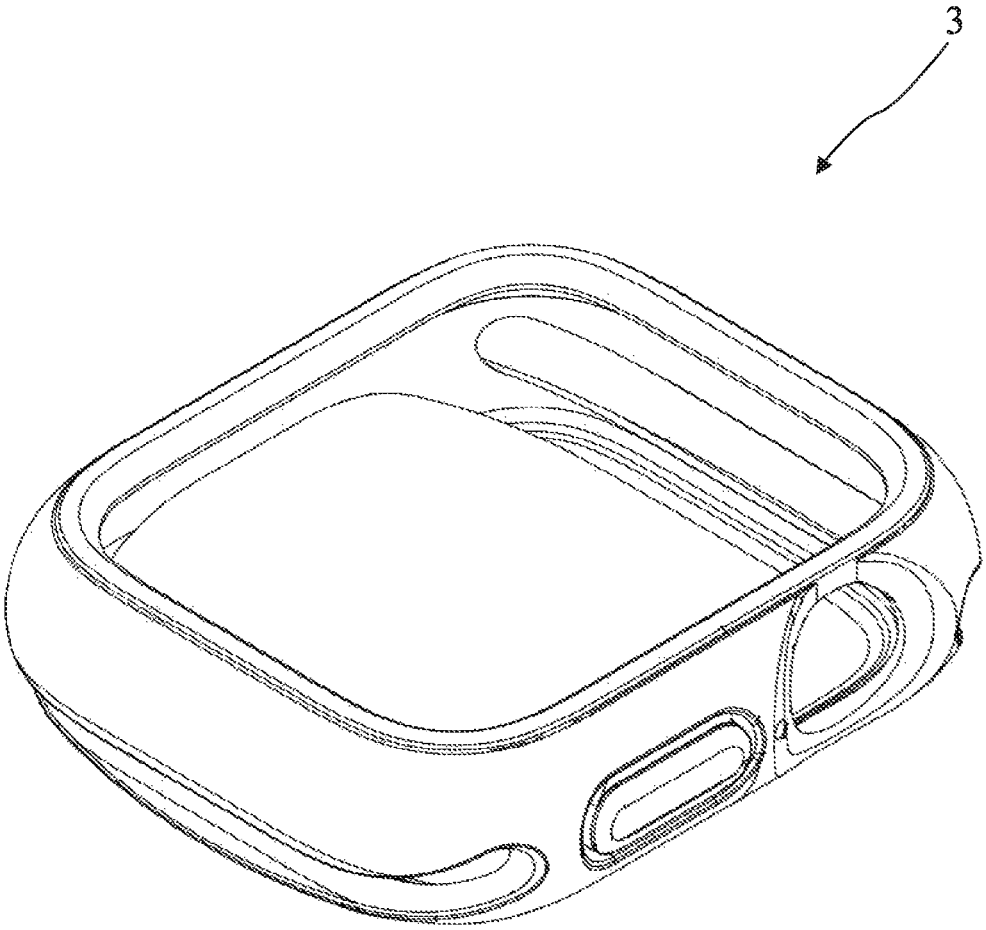
FIG. 3A is a stereogram illustrating a protection casing assembly according to some embodiments of the present disclosure.
Figure 3B:
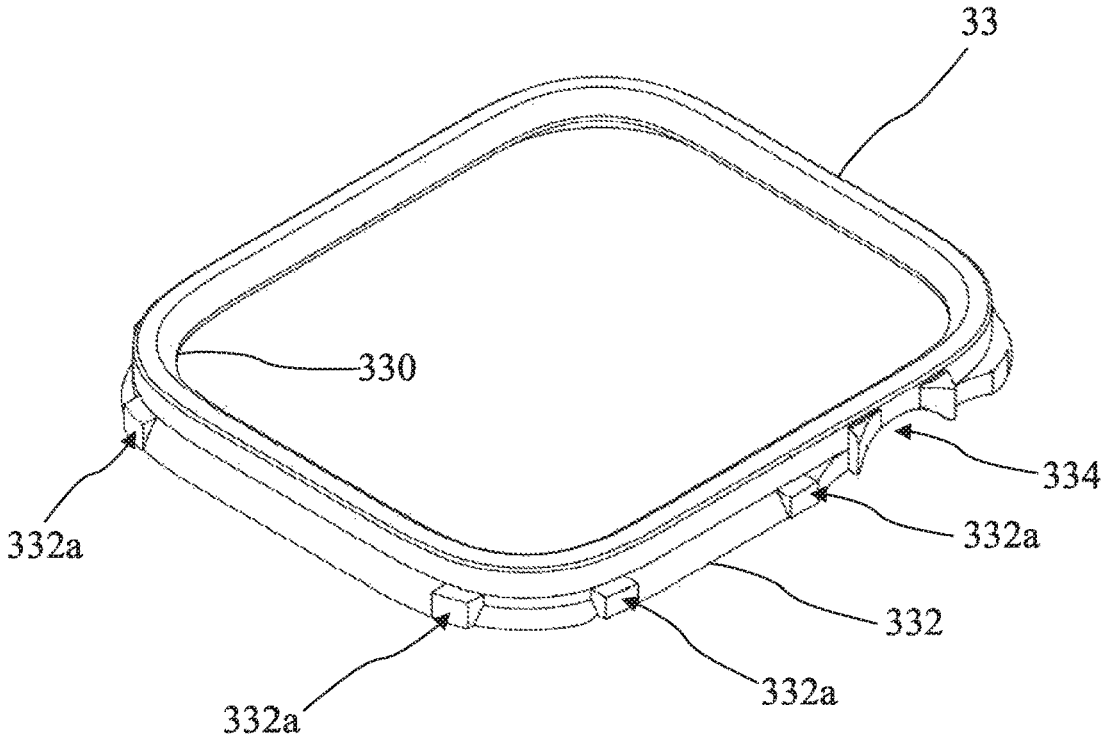
FIG. 3B is an exploded view of a protection casing assembly according to some embodiments of the present disclosure.
Figure 3B:
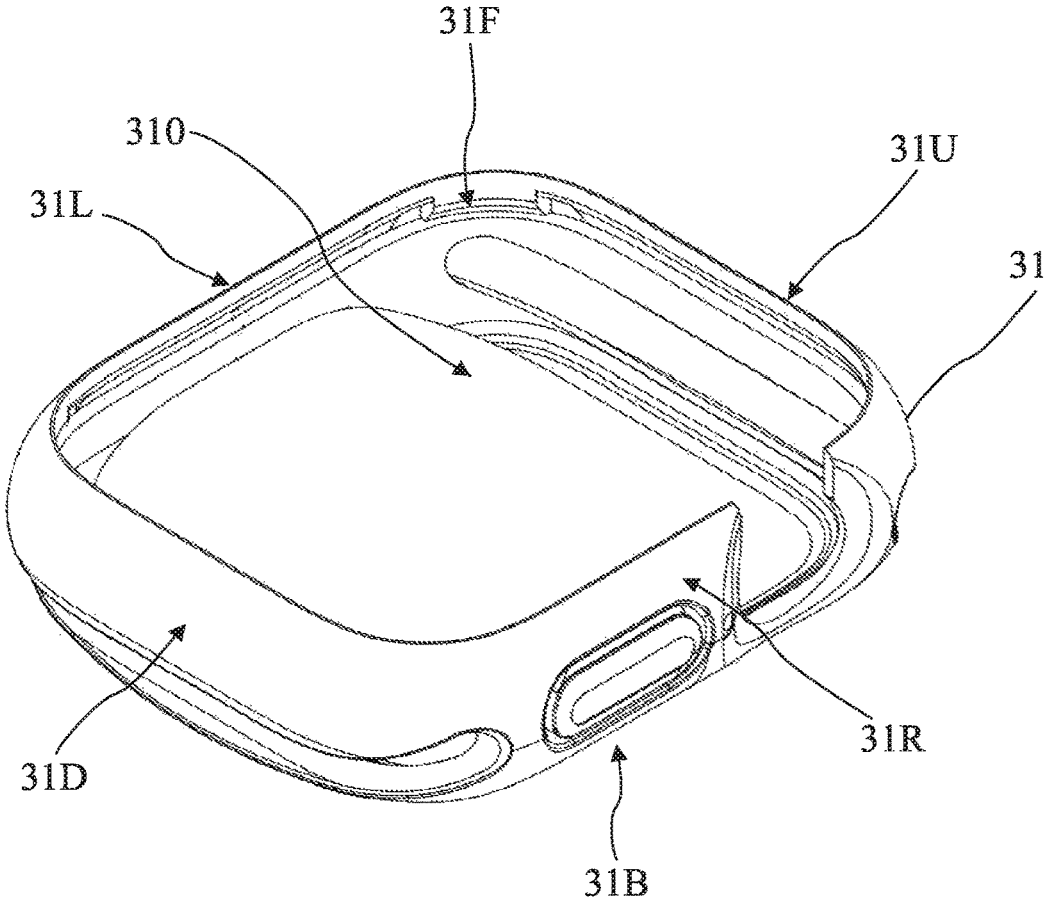
Figure 3C:
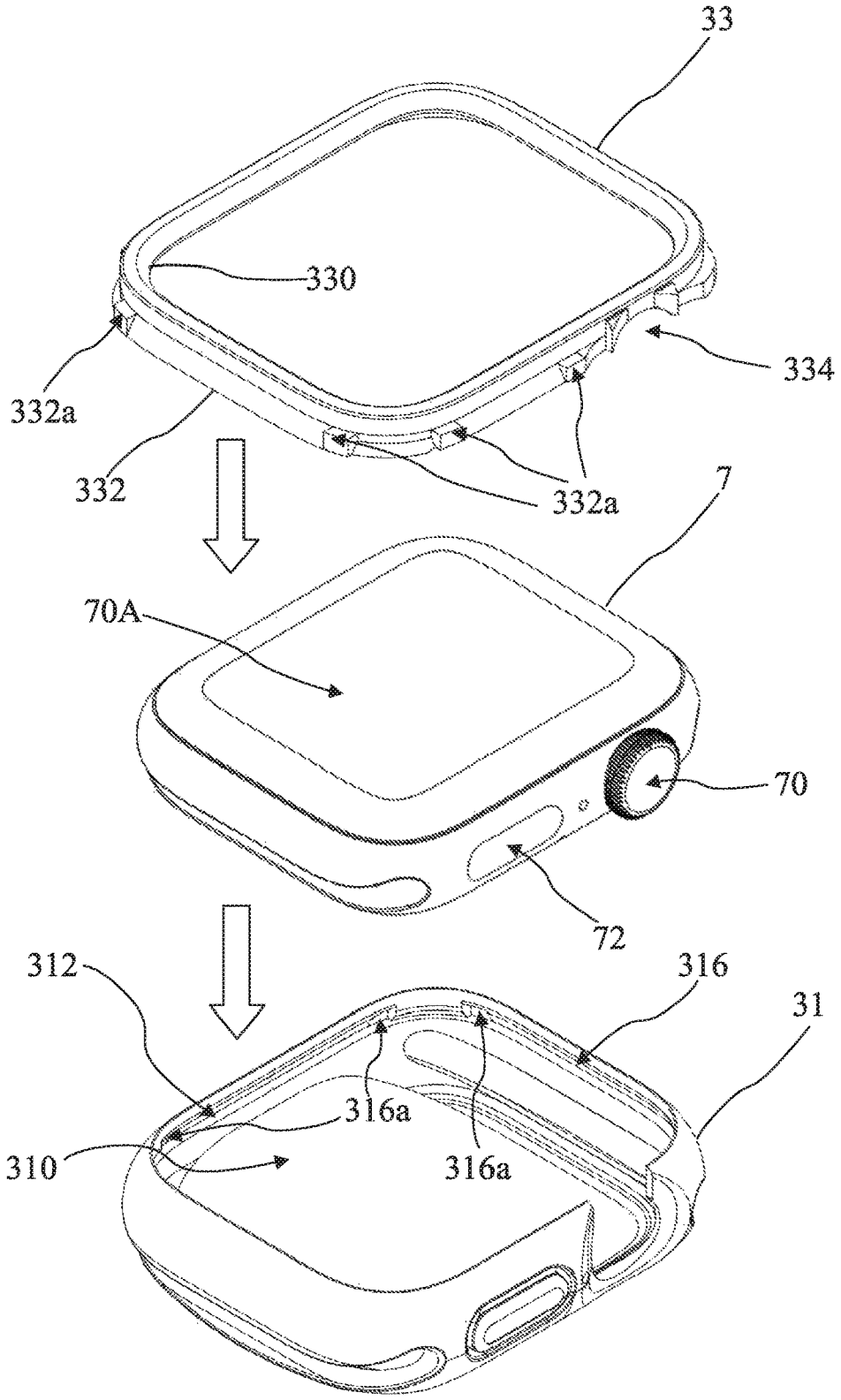
FIG. 3C is a schematic view illustrating the use of a protection casing assembly according to some embodiments of the present disclosure.
Figure 3D:
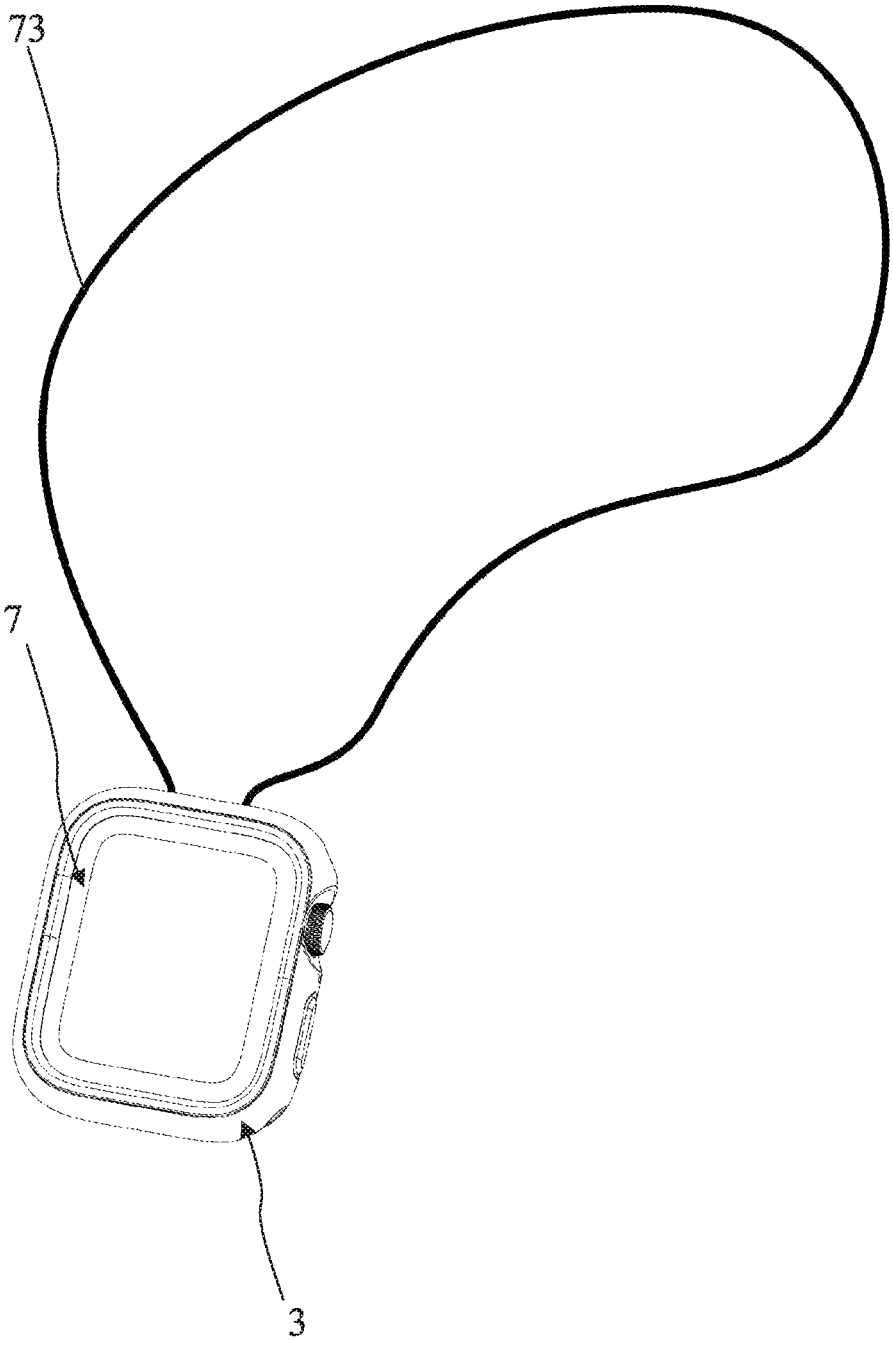
FIG. 3D is a schematic view illustrating the use of a protection casing assembly according to some embodiments of the present disclosure.
Figure 3E:
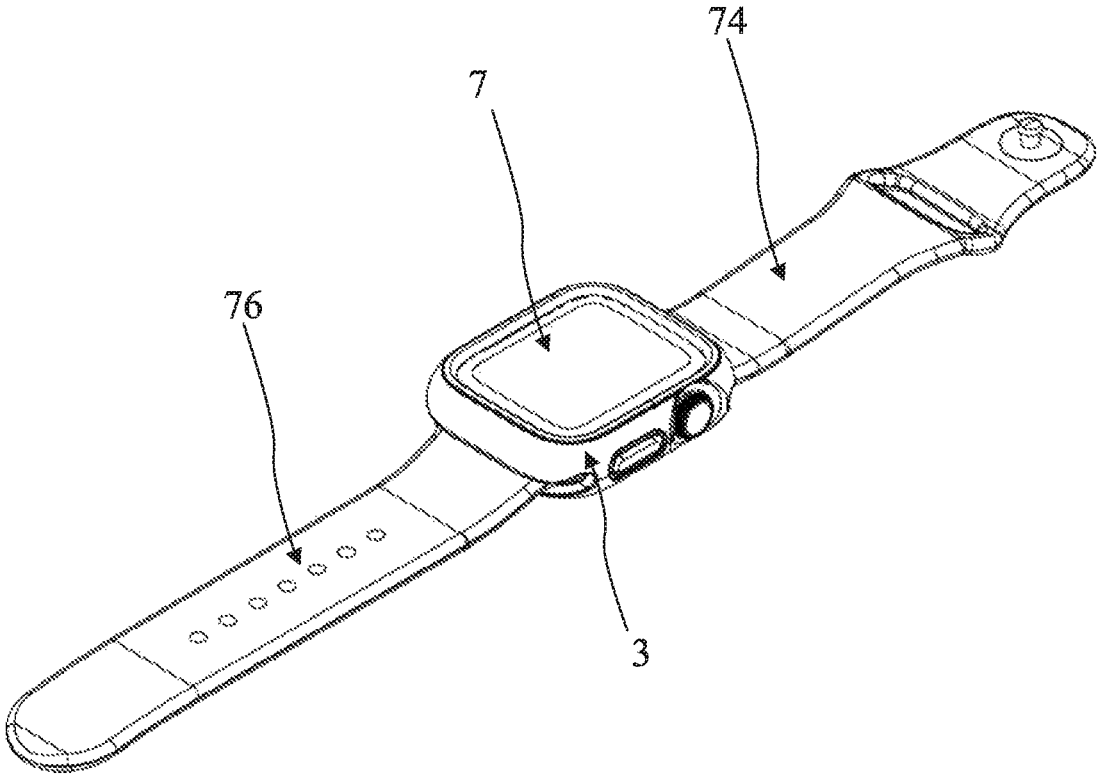
FIG. 3E is a schematic view illustrating the use of a protection casing assembly according to some embodiments of the present disclosure.

Referring to FIGS. 3A to 3E. FIG. 3A is a stereogram illustrating a protection casing assembly 3 in accordance with the third embodiment of the present disclosure. FIG. 3B is an exploded view of the protection casing assembly 3 in accordance with the third embodiment of the present disclosure. FIG. 3C is a schematic view illustrating the use of the protection casing assembly 3 in accordance with the third embodiment of the present disclosure. FIG. 3D is a schematic view illustrating the use of the protection casing assembly 3 in accordance with the third embodiment of the present disclosure in combination with a wearable device 7. FIG. 3E is another schematic view illustrating the use of the protection casing assembly 3 in accordance with the third embodiment of the present disclosure in combination with the wearable device 7.

As shown in the figures, the protection casing assembly 3 includes a main case 31 and a frame 33. The main case 31 may be substantially in shape of ring. The main case 31 has a right-side part 31R, a left-side part 31L opposite to the right-side part 31R, an upper part 31U adjoining the right-side part 31R and the left-side part 31L, a bottom part 31D opposite to the upper part 31U, a front opening 31F, a back opening 31B opposite to the front opening 31F, and a first accommodation space 310. The frame 33 includes a frame main body 330 and an insertion part 332. The insertion part 332 encircles the frame main body 330, and the insertion part 332 has a plurality of positioning bumps 332*a* disposed thereon.

In particular, when the wearable device 7 is disposed in the first accommodation space 310 via the front opening 31F, the wearable device 7 and the main case 31 define a second accommodation space 312 therebetween. The second accommodation space 312 may be in adjacent to a display surface 70A of the wearable device 7. In brief, when the wearable device 7 is disposed in the first accommodation space 310, the second accommodation space 312 may be defined in a position in adjacent to the display surface 70A.

More specifically, when an inner peripheral surface of the main case 31 wraps around a device peripheral surface of the wearable device 7, the inner peripheral surface of the main case 31 in adjacent to the display surface 70A may not be tightly fitted with the device peripheral surface of the wearable device 7, thereby creating gap, and this gap includes the second accommodation space 312. The inner side of the main case 31 has a notch 316 disposed at the second accommodation space 312, and the notch 316 has a plurality of positioning notches 316*a* disposed thereon.

Accordingly, after disposing the wearable device 7 in the first accommodation space 310 of the main case 31, the frame 33 may be disposed in the second accommodation space 312. In other words, the frame 33 may be disposed at the front opening 31F end of the main case 31, and may be inserted into the gap between the main case 31 and the wearable device 7 by means of insertion, thereby securing the wearable device 7 in the first accommodation space 310. Further, the insertion part 332 of the frame 33 may be configured to be inserted into the notch 316 of the second accommodation space 312 of the main case 31, and a plurality of positioning bumps 332*a* may be inserted and fitted into a plurality of positioning notches 316*a*, so as to strengthen the fixation of the frame 33 and the main case 31.

Figure 3F:
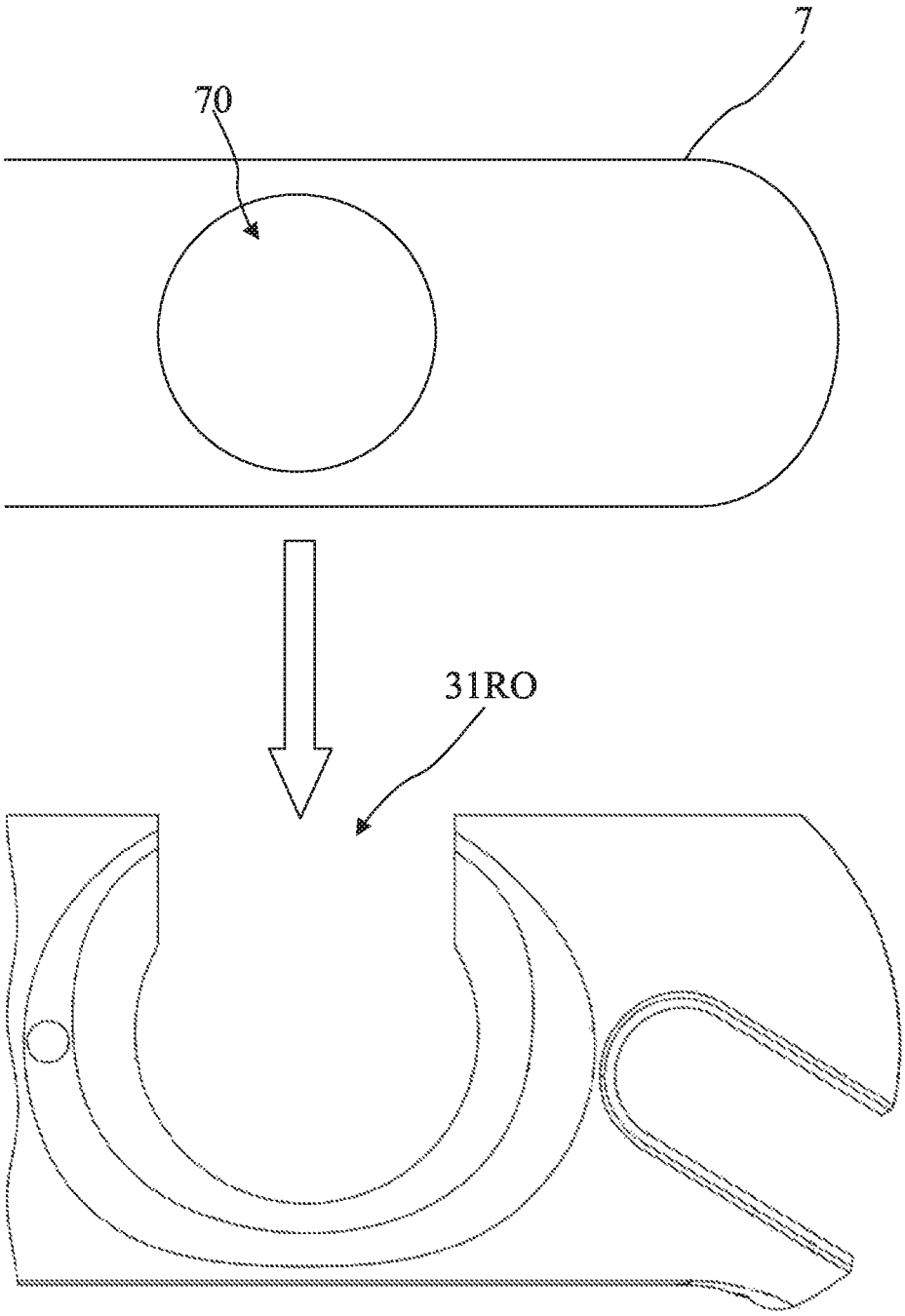
FIG. 3F is a partial enlargement view of an opening of a right-side part of a main case according to some embodiments of the present disclosure.

Referring to FIG. 3F, which is a partial enlargement view of an opening 31RO of the right-side part 31R of the main case 31 in accordance with the third embodiment of the present disclosure. Specifically, the right-side part 31R has the opening 31RO. The opening 31RO may be extended in the right-side part 31R to form a through hole, which corresponds to a component 70 of the wearable device 7.

Therefore, when the front opening 31F of the main case 31 receives the wearable device 7, the component 70 of the wearable device 7 may be inserted from the right-side part 31R via the opening 31RO. Hence, the convenience of accommodating the wearable device 7 in the first accommodation space 310 of the main case 31 may be enhanced. In some embodiments, the right-side part 31R forms an inward recess at the through hole formed by the extension of the opening 31RO, which facilitate the operation of the component 70 by the user.

For example, the wearable device 7 is a watch and the component 70 is a watch crown. When the front opening 31F of the main case 31 receives the watch, the watch crown may be inserted into the opening 31RO of the right-side part 31R directly. When the watch is placed in the first accommodation space 310 of the main case 31, since the right-side part 31R forms the inward recess at the through hole formed by the extension of the opening 31RO, a space, which is defined by the inward recess relative to the main case 31, thereby facilitates the operation of the watch crown by the user.

In some embodiments, the frame 33 has a curved recess 334 at a position corresponding to the component 70 of the wearable device 7. The curved recess 334 may be configured to frame, in conjunction with the opening 31RO, the component 70 of the wearable device 7 when the frame 33 is combined with the main case 31.

Figure 3G:
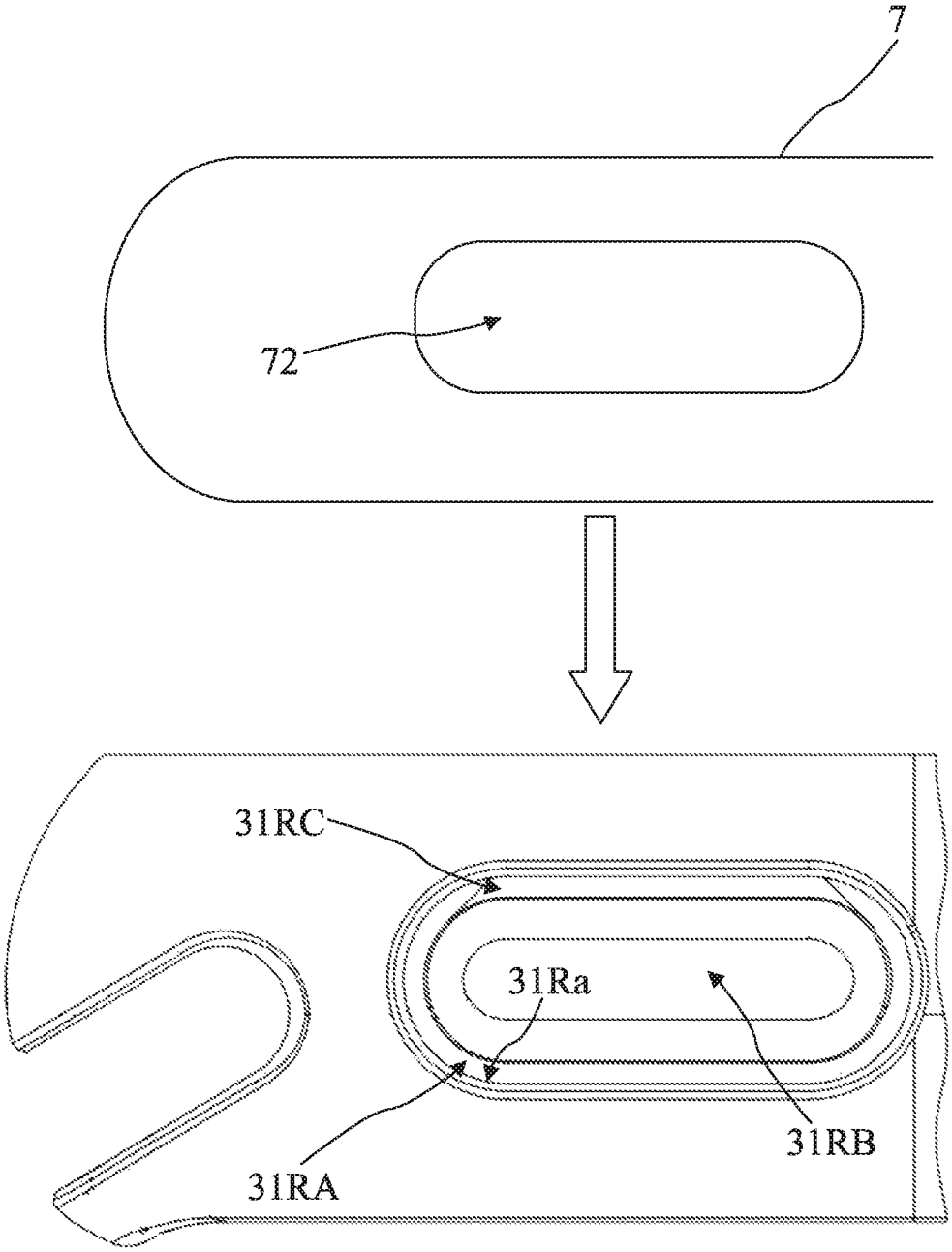
FIG. 3G is a partial enlargement view of a right-side part of a main case according to some embodiments of the present disclosure.

Referring to FIG. 3G, which is another partial enlargement view of the right-side part 31R of the main case 31 in accordance with the third embodiment of the present disclosure. Specifically, the right-side part 31R may be disposed with a through hole 31RA, a button unit 31RB and a connecting unit 31RC, corresponding to a button 72 of the wearable device 7. The through hole 31RA has an inner peripheral surface 31Ra, and the button unit 31RB may be disposed relatively to the inner peripheral surface 31Ra. The connecting unit 31RC may be configured to connect the button unit 31RB to a portion of the inner peripheral surface 31Ra. Accordingly, when the wearable device 7 is placed in the accommodation space 310 of the main case 31, the button unit 31RB corresponds to the button 72 of the wearable device 7, so that the user may press the button 72 of the wearable device 7 by pressing the button unit 31RB.

Figure 3H:
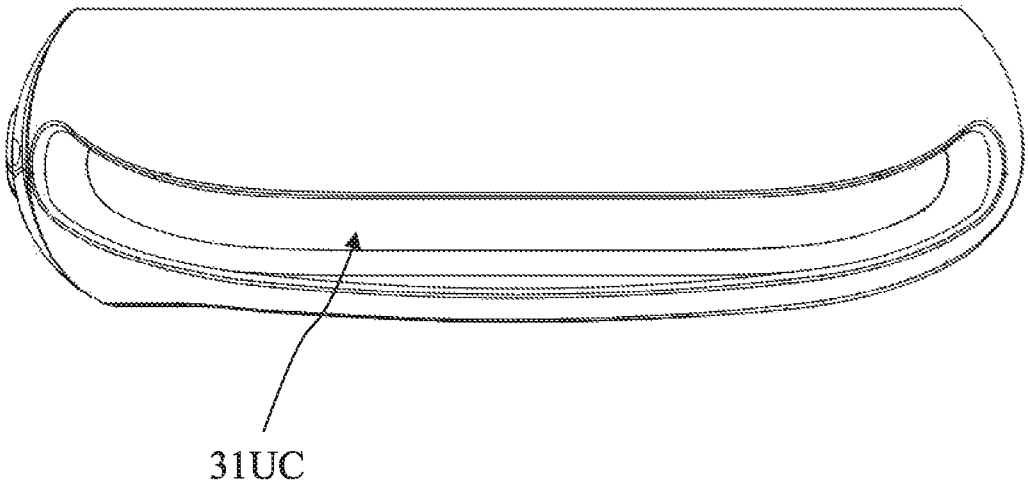
FIG. 3H is a front view of an upper part 31U of a main case according to some embodiments of the present disclosure.

Referring to FIGS. 3D and 3H. FIG. 3H is a front view of the upper part 31U of the main case 31 in accordance with the third embodiment of the present disclosure. The upper part 31U has a first connecting unit 31UC, which may be configured to connect with a wearable accessory 73 of the wearable device 7. As shown in FIG. 3D, the wearable accessory 73 may be a neckless-like accessory, which is connected with the first connecting unit 31UC of the upper part 31U of the main case 31. Accordingly, the user may wear the wearable device 7 wrapped in the protection casing assembly 3 using the wearable accessory 73.

Figure 3I:
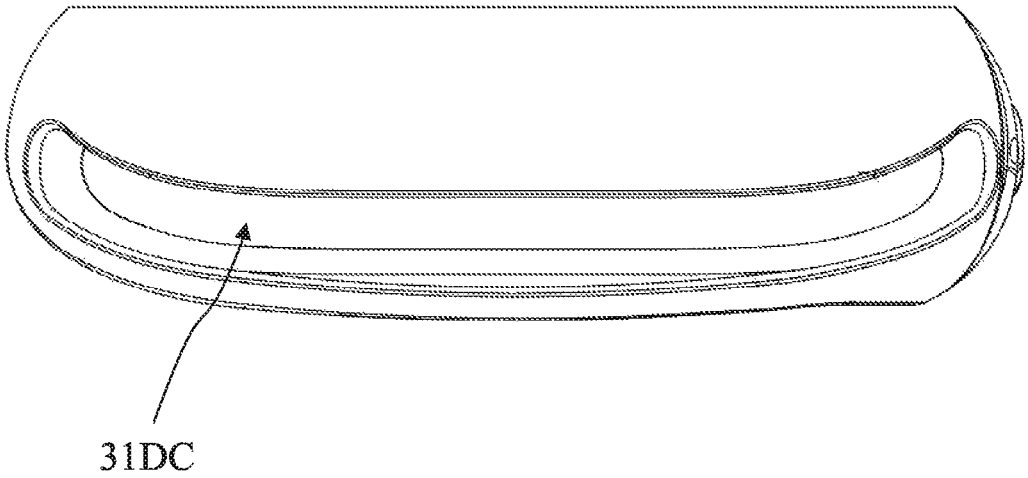
FIG. 3I is a front view of a bottom part of a main case according to some embodiments of the present disclosure.

Referring to FIGS. 3E, 3H and 3I, which illustrate another embodiment of wearing. FIG. 3I is a front view of the bottom part 31D of the main case 31 in accordance with the third embodiment of the present disclosure. Specifically, in this embodiment, the first connecting unit 31U of the upper part 31UC may be configured to connect with a first wearable accessory 74 of the wearable device 7. The bottom part 31D has a second connecting unit 31DC, which is configured to connect a second wearable accessory 76 of the wearable device 7. Accordingly, the user may wear the wearable device 7 wrapped in the protection casing assembly 3 using the wearable accessory 74, 76.

It should be noted that in some embodiments, the first connecting unit 31UC has a shape corresponding to the connection part of the first wearable accessory 74. Therefore, the first connecting unit 31UC may adapt the first wearable accessory 74 directly. Similarly, the second connecting unit 31DC has a shape corresponding to the connection part of the second wearable accessory 76. Therefore, the second connecting unit 31DC may adapt the second wearable accessory 76 directly.

In some embodiments, the first connecting unit 31UC and the second connecting unit 31DC may include through holes, which are designed correspondingly to the mechanism of the wearable device 7 adapting the wearable accessory. Therefore, the first connecting unit 31UC and the second connecting unit 31DC may receive the first wearable accessory 74 and second wearable accessory 76 of the wearable device 7, respectively, so that the first wearable accessory 74 and second wearable accessory 76 may be adapted by the wearable device 7 directly.

In some embodiments, the first connecting unit 31UC may include a strip-like through hole, whereas the two ends of this strip-like through hole extend into a portion of the left-side part 31L and a portion of the right-side part 31R, respectively. Similarly, the second connecting unit 31DC may include a strip-like through hole, whereas the two ends of this strip-like through hole extend into a portion of the left-side part 31L and a portion of the right-side part 31R, respectively.

For example, when the wearable device 7 is a watch and the wearable accessories 74, 76 are watch straps, the first connecting unit 31UC and the second connecting unit 31DC are configured to connect with the watch strap. Accordingly, the user may wear the watch wrapped in the protection casing assembly 3 by using the watch straps.

Figure 3J:
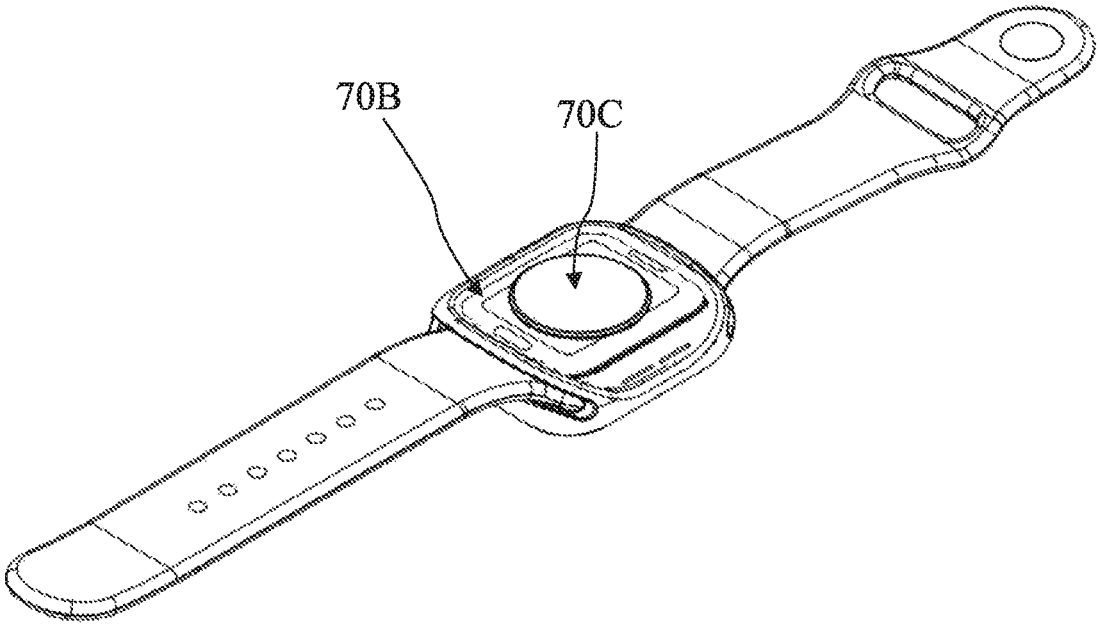
FIG. 3J is a stereogram illustrating a protection casing assembly according to some embodiments of the present disclosure.

Referring to FIG. 3J, which is a stereogram illustrating the protection casing assembly 3 in accordance with the third embodiment of the present disclosure in combination with the wearable device 7. Specifically, the wearable device 7 has a display surface 70A and a device back side 70B opposite to the display surface 70A, and the device back side 70B has a sensing component 70C disposed thereon. When the front opening 31F receives the wearable device 7, and the wearable device 7 may be disposed in the first accommodation space 310, the front opening 31F may be configured to expose the display surface 70A, and the back opening 31B may be configured to expose the sensing component 70C.

Further, the sensing component 70C may be configured to sense the physiological signals of human body. Hence, when the wearable device 7 is wrapped in the protection casing assembly 3 and worn by the user, the arrangement of the back opening 31B exposing the sensing component 70C may maintain the function for sensing the physiological signals by the sensing component 70C.

Figure 3K:
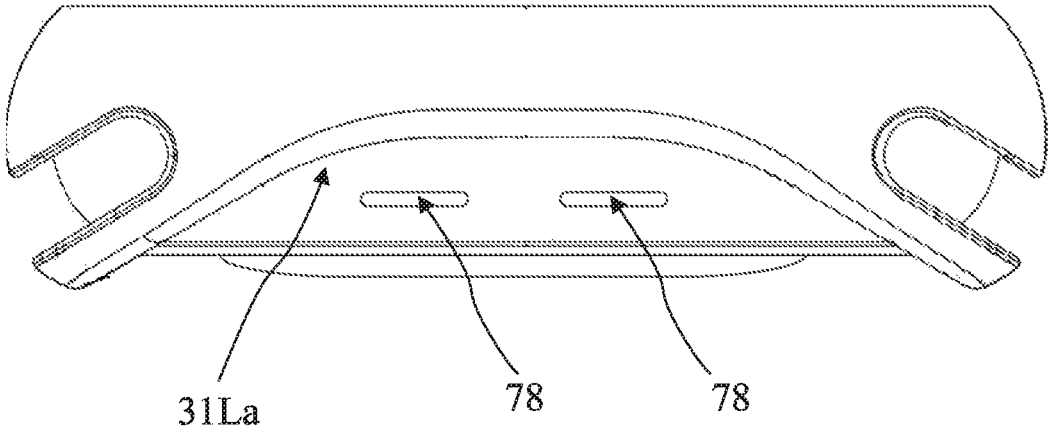
FIG. 3K is a front view of a left-side part of a main case according to some embodiments of the present disclosure.

Referring to FIG. 3K, which is a front view of the left-side part 31L of the third embodiment of the present disclosure. Specifically, a recess 31La may be formed on the left-side part 31L and adjacent to the back opening 31B. The recess 31La may be configured to correspond to at least one audio output 78 of the wearable device 7, so as to avoid the impact on sound output when the wearable device 7 is placed in the first accommodation space 310.

It should be noted that when the reflective light of the main case 31 and the frame 33 has the same wavelength (that is, having the same color), the user may experience some difficulty in judging, intuitively, whether the frame 33 has been combined with the main case 31. Hence, when the wearable device 7 is places in the main case 31 and the frame 33 may not be combined with the main case 31, if the user mistakenly determines that the frame 33 has been combined with the main case 31, the wearable device 7 may not be protected thoroughly. Accordingly, in some embodiments, when the light is irradiated on the main case 31, the main case 31 reflects the light having a first wavelength, and when the light is irradiated on the frame 33, the frame 33 reflects the light having a second wavelength. The first wavelength and the second wavelength may be different (that is, having different colors). In this way, the user may clearly determine whether the frame 33 has been combined with the main case 31 by using the different colors, so as to avoid the above-mentioned case of misjudgment.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A protection casing assembly for a wearable device, comprising:

a main case, having a first accommodation space and configured to allow the wearable device to be disposed detachably, wherein when the wearable device is disposed in the first accommodation space, the wearable device and the main case define a second accommodation space adjacent to a display surface of the wearable device; and a frame, detachably disposed in the second accommodation space.

2. The protection casing assembly of claim 1, wherein the main case has an inner peripheral surface, wherein the inner peripheral surface is disposed with a notch, and the frame has an insertion part, configured to be inserted into the notch.

3. The protection casing assembly of claim 2, wherein the notch further comprises at least one positioning notch, the insertion part further comprises at least one positioning bump, and when the frame is inserted into the notch, the at least one positioning bump is inserted and fitted into the at least one positioning notch.

4. The protection casing assembly of claim 1, wherein the main case further comprises:

a lateral part, having an opening and configured to allow a component of the wearable device to be inserted from the lateral part.

5. The protection casing assembly of claim 1, wherein the main case further comprises:

a first lateral part, having a first connecting unit and configured to connect a first wearable accessory of the wearable device.

6. The protection casing assembly of claim 5, wherein the main case further comprises:

a second lateral part, having a second connecting unit and configured to connect a second wearable accessory of the wearable device.

7. The protection casing assembly of claim 6, wherein the first connecting unit and the second connecting unit include through holes that are respectively configured to receive the first wearable accessory and the second wearable accessory of the wearable device.

8. The protection casing assembly of claim 1, wherein the main case further comprises:

a lateral part, having:

a through hole, having an inner peripheral surface;

a button unit, disposed relatively to the inner peripheral surface; and a connecting unit, configured to connect the button unit with a portion of the inner peripheral surface.

9. The protection casing assembly of claim 1, wherein when the frame is disposed in the second accommodation space, the frame has a bulge corresponding to a periphery of the main case.

10. The protection casing assembly of claim 1, wherein the main case further has:

an opening, configured to expose a sensing component of the wearable device when the wearable device is disposed in the first accommodation space.

11. The protection casing assembly of claim 1, wherein the main case reflects light having a first wavelength, the frame reflects light having a second wavelength, and the first wavelength differs from the second wavelength.

12. A wearable device protection casing, comprising:

a first accommodation space, configured to allow a wearable device to be disposed detachably, wherein when the wearable device is disposed in the first accommodation space, the wearable device and the wearable device protection casing define a second accommodation space adjacent to a display surface of the wearable device and the second accommodation space is configured to allow a frame to be disposed detachably.

13. A protection casing assembly for a wearable device, comprising:

a main case, having:

an opening, configured to receive the wearable device; and an accommodation space, configured to accommodate the wearable device; and a frame, disposed in the opening, inserted between the main case and the wearable device and adjacent to a display surface of the wearable device, and configured to secure the wearable device in the accommodation space.

* * * * *